US010217397B2

(12) United States Patent
Lee et al.

(10) Patent No.: US 10,217,397 B2
(45) Date of Patent: Feb. 26, 2019

(54) METHOD OF OPERATING A DISPLAY APPARATUS AND A DISPLAY APPARATUS PERFORMING THE SAME

(71) Applicant: SAMSUNG DISPLAY CO., LTD., Yongin-si, Gyeonggi-do (KR)

(72) Inventors: Ki-Seob Lee, Seongnam-si (KR); Sangrock Yoon, Hwaseong-si (KR); Dongin Kim, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/488,930

(22) Filed: Apr. 17, 2017

(65) Prior Publication Data

US 2017/0345360 A1 Nov. 30, 2017

(30) Foreign Application Priority Data

May 25, 2016 (KR) ..... 10-2016-0064351

(51) Int. Cl.
*G09G 3/20* (2006.01)

(52) U.S. Cl.
CPC ..... *G09G 3/2092* (2013.01); *G09G 3/20* (2013.01); *G09G 2310/08* (2013.01); *G09G 2320/08* (2013.01); *G09G 2320/10* (2013.01); *G09G 2320/103* (2013.01); *G09G 2330/06* (2013.01); *G09G 2370/08* (2013.01); *G09G 2370/14* (2013.01)

(58) Field of Classification Search
CPC .... G09G 3/2092; G09G 3/20; G09G 2330/06; G09G 2370/08; G09G 2370/14; G09G 2320/08; G09G 2320/103; G09G 2310/08
See application file for complete search history.

(56) References Cited

U.S. PATENT DOCUMENTS 5,920,592 A * 7/1999 Tanaka ..... H04W 88/02 375/219
8,884,934 B2 11/2014 Jeon et al.
9,240,159 B2 1/2016 Na et al.
(Continued)

FOREIGN PATENT DOCUMENTS

KR 1020080041334 6/2008
KR 1020140056615 5/2014
(Continued)

OTHER PUBLICATIONS

European Search Report dated Oct. 20, 2017 in the corresponding European Patent Application No. 17172945.2.

*Primary Examiner* — Mihir K Rayan

(74) *Attorney, Agent, or Firm* — F. Chau & Associates, LLC

(57) ABSTRACT

In a method of operating a display apparatus, during a first period in which image data is provided to a data driver, a clock embedded data signal having an output differential voltage ("VOD") set to a first voltage value is applied to the data driver. The VOD of the clock embedded data signal relates to a voltage difference between a high level and a low level of the clock embedded data signal. During a second period in which the image data is not provided to the data driver, the VOD of the clock embedded data signal applied to the data driver is changed to a second voltage value smaller than the first voltage value.

33 Claims, 28 Drawing Sheets

(56) References Cited

U.S. PATENT DOCUMENTS

| | | | | |
|---|---|---|---|---|
| 9,418,626 | B2 * | 8/2016 | Reynolds | G06F 3/0418 |
| 2005/0195280 | A1 * | 9/2005 | Murakami | G09G 3/007 348/173 |
| 2005/0201537 | A1 * | 9/2005 | Honda | G06F 13/4291 379/100.17 |
| 2010/0066723 | A1 * | 3/2010 | Nam | G09G 3/20 345/213 |
| 2010/0289945 | A1 * | 11/2010 | Kobayashi | G06F 1/3218 348/441 |
| 2010/0289966 | A1 * | 11/2010 | Kobayashi | G09G 5/006 348/725 |
| 2016/0247473 | A1 | 8/2016 | Matsuda et al. | |

FOREIGN PATENT DOCUMENTS

| | | |
|---|---|---|
| KR | 1020140076252 | 6/2014 |
| WO | 2015050136 | 4/2015 |

* cited by examiner

METHOD OF OPERATING A DISPLAY APPARATUS AND A DISPLAY APPARATUS PERFORMING THE SAME

CROSS-REFERENCE TO RELATED APPLICATION

This application claims priority under 35 U.S.C. § 119 to Korean Patent Application No. 10-2016-0064351, filed on May 25, 2016 in the Korean Intellectual Property Office (KIPO), the disclosure of which is incorporated by reference herein in its entirety.

TECHNICAL FIELD

Exemplary embodiments of the present inventive concept relate to displaying images, and more particularly to methods of operating display apparatuses and display apparatuses performing the methods.

DESCRIPTION OF THE RELATED ART

A display apparatus, such as a flat panel display ("FPD"), is widely used. There exists a variety of types of FPDs including, but not limited to, a liquid crystal display ("LCD"), a plasma display panel ("PDP") and an organic light emitting display ("OLED"), for example.

The display apparatus may be used in various electronic systems, such as a mobile phone, a smart phone, a tablet computer, a personal digital assistant ("PDA"), etc. In an electronic system, receiver desensitization, also referred to as ("desense"), or simply degradation of the receiver's sensitivity, may result from noise generated by the display apparatus. Accordingly, communication performance of the electronic system may become degraded.

SUMMARY

According to exemplary embodiments of the present inventive concept, in a method of operating a display apparatus, during a first period in which image data is provided to a data driver, a clock embedded data signal having an output differential voltage ("VOD") set to a first voltage value is applied to the data driver. The VOD of the clock embedded data signal relates to a voltage difference between a high level and a low level of the clock embedded data signal. During a second period in which the image data is not provided to the data driver, the VOD of the clock embedded data signal applied to the data driver is changed to a second voltage value smaller than the first voltage value.

In an exemplary embodiment of the present inventive concept, the second voltage value may be equal to or greater than approximately 30% of the first voltage value and may be equal to or smaller than approximately 80% of the first voltage value.

In an exemplary embodiment of the present inventive concept, the second period may include a first blank period between two consecutive frame periods for displaying two consecutive frame images.

In an exemplary embodiment of the present inventive concept, the second period may further include a second blank period between two consecutive line periods for displaying two consecutive line images in one frame image.

In an exemplary embodiment of the present inventive concept, during the first period, a slew rate of the clock embedded data signal may be set to a first time value. The slew rate of the clock embedded data signal may relate to a time required to transition from one of the high level and the low level of the clock embedded data signal to the other of the high level and the low level of the clock embedded data signal. During the second period, the slew rate of the clock embedded data signal applied to the data driver may be changed to a second time value greater than the first time value.

In an exemplary embodiment of the present inventive concept, the second time value may be greater than the first time value and may be equal to or smaller than approximately three times the first time value.

In an exemplary embodiment of the present inventive concept, during the second period, the clock embedded data signal applied to the data driver is not toggled.

In an exemplary embodiment of the present inventive concept, it may be determined whether the image data corresponds to a static image. During at least one of the first period and the second period, the VOD of the clock embedded data signal may be additionally adjusted when the image data corresponds to the static image.

In an exemplary embodiment of the present inventive concept, the first period may include a first frame period for displaying a first frame image, and a second frame period for displaying a second frame image. The first and second frame images may be two consecutive frames images. The second period may include a first blank period between the first frame period and the second frame period, and a second blank period after the second frame period. The VOD of the clock embedded data signal may be set to the first voltage value during the first frame period, and the VOD of the clock embedded data signal may be changed from the first voltage value to the second voltage value during the first blank period.

In an exemplary embodiment of the present inventive concept, when the second frame image is substantially the same as the first frame image, the VOD of the clock embedded data signal may be changed to a third voltage value during the second frame period. The third voltage value may be smaller than the first voltage value and may be greater than the second voltage value.

In an exemplary embodiment of the present inventive concept, when the second frame image is substantially the same as the first frame image, the VOD of the clock embedded data signal may be changed to a third voltage value during the second blank period. The third voltage value may be smaller than the second voltage value.

In an exemplary embodiment of the present inventive concept, in applying the clock embedded data signal to the data driver during the first period, a first high voltage and a first low voltage may be generated. The clock embedded data signal may be output in response to the first high voltage and the first low voltage. A difference between the first high voltage and the first low voltage may be substantially equal to the first voltage value.

In an exemplary embodiment of the present inventive concept, in changing the VOD of the clock embedded data signal during the second period, a second high voltage and a second low voltage may be generated. The second high voltage may have a level lower than that of the first high voltage. The second low voltage may have a level higher than that of the first low voltage. The clock embedded data signal may be output in response to the second high voltage and the second low voltage. A difference between the second high voltage and the second low voltage may be substantially equal to the second voltage value.

According to exemplary embodiments of the present inventive concept, in a method of operating a display apparatus, during a first period in which image data is provided to a data driver, a clock signal having a VOD set to a first voltage value is applied to the data driver. The VOD of the clock signal represents a voltage difference between a high level and a low level of the clock signal. During a second period in which the image data is not provided to the data driver, the VOD of the clock signal applied to the data driver is changed to a second voltage value smaller than the first voltage value.

In an exemplary embodiment of the present inventive concept, the second voltage value may be equal to or greater than approximately 30% of the first voltage value and may be equal to or smaller than approximately 80% of the first voltage value.

In an exemplary embodiment of the present inventive concept, during the first period, a slew rate of the clock signal may be set to a first time value. The slew rate of the clock signal may relate to a time required to transition from one of the high level and the low level of the clock signal to the other of the high level and the low level of the clock signal. During the second period, the slew rate of the clock signal applied to the data driver may be changed to a second time value greater than the first time value.

In an exemplary embodiment of the present inventive concept, the second time value may be greater than the first time value and may be equal to or smaller than approximately three times the first time value.

In an exemplary embodiment of the present inventive concept, in applying the clock signal to the data driver during the first period, a first high voltage and a first low voltage may be generated. The clock signal may be output in response to the first high voltage and the first low voltage. A difference between the first high voltage and the first low voltage may be substantially equal to the first voltage value.

In an exemplary embodiment of the present inventive concept, in changing the VOD of the clock signal during the second period, a second high voltage having a level lower than that of the first high voltage may be generated. The clock signal may be output in response to the second high voltage and the first low voltage. A difference between the second high voltage and the first low voltage may be substantially equal to the second voltage value.

In an exemplary embodiment of the present inventive concept, in changing the VOD of the clock signal during the second period, a second high voltage and a second low voltage may be generated. The second high voltage may have a level lower than that of the first high voltage. The second low voltage may have a level higher than that of the first low voltage. The clock signal may be output in response to the second high voltage and the second low voltage. A difference between the second high voltage and the second low voltage may be substantially equal to the second voltage value.

According to exemplary embodiments of the present inventive concept, a display apparatus includes a display panel, a data driver and a timing controller. The data driver is connected to the display panel. The timing controller applies a clock embedded data signal to the data driver and sets a VOD of the clock embedded data signal, wherein the VOD of the clock signal relates to a voltage difference between a high level and a low level of the clock embedded data signal. The VOD of the clock embedded data signal is set to a first voltage value during a first period in which image data is provided to the data driver, and the VOD of the clock embedded data signal is changed to a second voltage value smaller than the first voltage value during a second period in which the image data is not provided to the data driver.

In an exemplary embodiment of the present inventive concept, the second voltage value may be equal to or greater than approximately 30% of the first voltage value and may be equal to or smaller than approximately 80% of the first voltage value.

In an exemplary embodiment of the present inventive concept, the second period may include a first blank period between two consecutive frame periods for displaying two consecutive frame images on the display panel.

In an exemplary embodiment of the present inventive concept, the second period may further include a second blank period between two consecutive line periods for displaying two consecutive line images in one frame image displayed on the display panel.

In an exemplary embodiment of the present inventive concept, the timing controller may set a slew rate of the clock embedded data signal to a time required to transition from one of the high level and the low level of the clock embedded data signal to the other of the high level and the low level of the clock embedded data signal. The slew rate of the clock embedded data signal may be set to a first time value during the first period, and the slew rate of the clock embedded data signal may be changed to a second time value greater than the first time value during the second period.

In an exemplary embodiment of the present inventive concept, the second time value may be greater than the first time value and may be equal to or smaller than approximately three times the first time value.

In an exemplary embodiment of the present inventive concept, the timing controller may prevent the clock embedded data signal from toggling during the second period.

In an exemplary embodiment of the present inventive concept, the timing controller may determine whether the image data corresponds to a static image, and during at least one of the first period and the second period, may additionally adjust the VOD of the clock embedded data signal when the image data corresponds to the static image.

In an exemplary embodiment of the present inventive concept, the first period may include a first frame period for displaying a first frame image, and a second frame period for displaying a second frame image. The first and second frame images may be two consecutive frame images. The second period may include a first blank period between the first frame period and the second frame period, and a second blank period after the second frame period. The VOD of the clock embedded data signal may be set to the first voltage value during the first frame period, and the VOD of the clock embedded data signal may be changed from the first voltage value to the second voltage value during the first blank period.

In an exemplary embodiment of the present inventive concept, when the second frame image is substantially the same as the first frame image, the VOD of the clock embedded data signal may be changed from the second voltage value to a third voltage value during the second frame period. The third voltage value may be smaller than the first voltage value and may be greater than the second voltage value.

In an exemplary embodiment of the present inventive concept, when the second frame image is substantially the same as the first frame image, the VOD of the clock embedded data signal may be changed to a third voltage value during the second blank period. The third voltage value may be smaller than the second voltage value.

In an exemplary embodiment of the present inventive concept, the timing controller may include a voltage generator and a clock embedded data signal generator. The voltage generator may generate a first high voltage, a first low voltage, a second high voltage and a second low voltage. The second high voltage may have a level lower than that of the first high voltage. The second low voltage may have a level higher than that of the first low voltage. The clock embedded data signal generator may generate the clock embedded data signal in response to the first high voltage, the first low voltage, the second high voltage and the second low voltage.

In an exemplary embodiment of the present inventive concept, the clock embedded data signal generator may output the clock embedded data signal having the VOD of the first voltage value in response to the first high voltage and the first low voltage during the first period, and may output the clock embedded data signal having the VOD of the second voltage value in response to the second high voltage and the second low voltage during the second period.

According to exemplary embodiments of the present inventive concept, a display apparatus includes a display panel, a data driver and a timing controller. The data driver is connected to the display panel. The timing controller applies image data and a clock signal to the data driver and sets a VOD of the clock signal, wherein the VOD of the clock signal relates to a voltage difference between a high level and a low level of the clock signal. The VOD of the clock signal is set to a first voltage value during a first period in which the image data is provided to the data driver, and the VOD of the clock signal is changed to a second voltage value smaller than the first voltage value during a second period in which the image data is not provided to the data driver.

BRIEF DESCRIPTION OF THE DRAWINGS

The above and other features of the present inventive concept will become more apparent by describing in detail exemplary embodiments thereof with reference to the accompanying drawings.

DETAILED DESCRIPTION OF THE EMBODIMENTS

Figure 1:
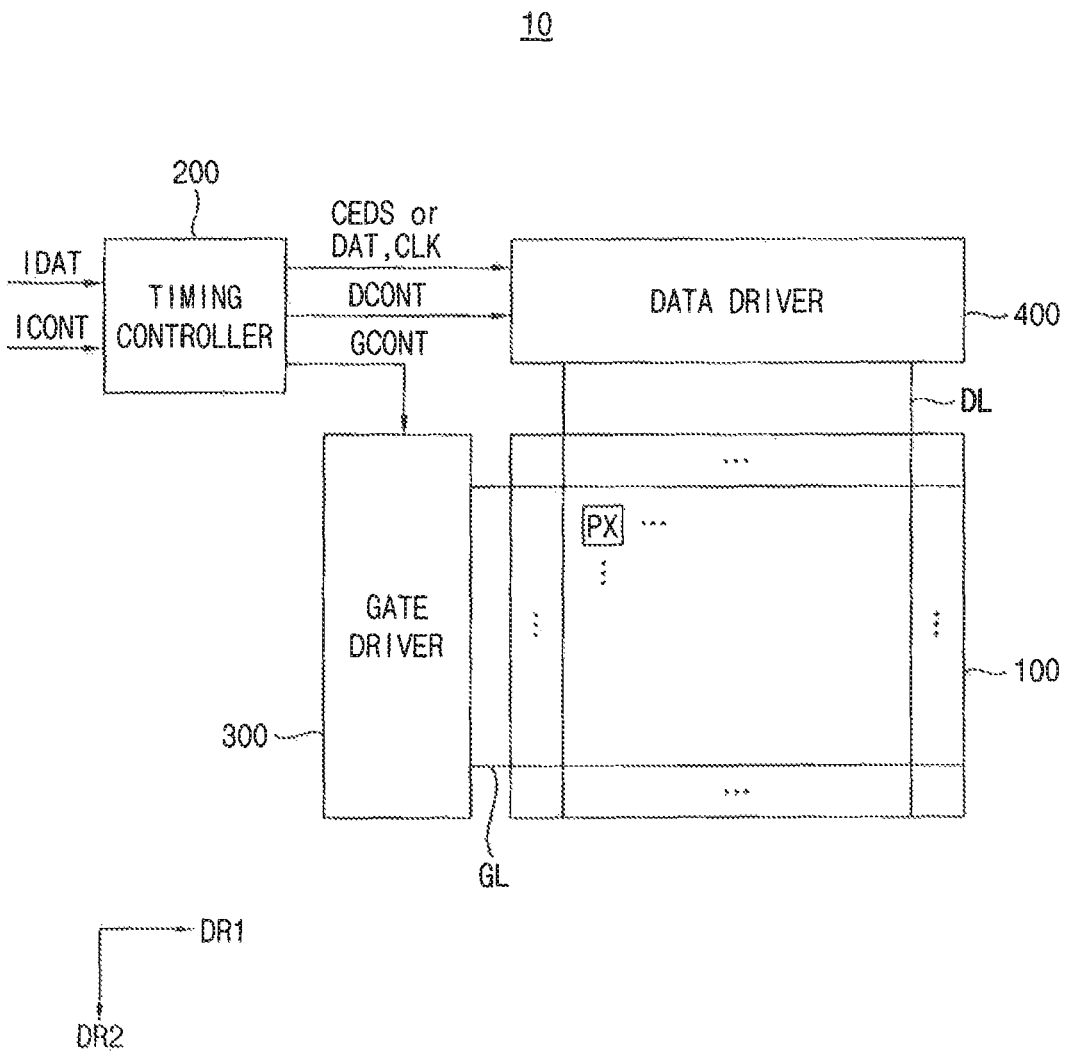
FIG. 1 is a block diagram illustrating a display apparatus according to exemplary embodiments of the present inventive concept.

Various exemplary embodiments of the present inventive concept will be described more fully with reference to the accompanying drawings. This inventive concept may, however, be embodied in many different forms and should not be construed as limited to the embodiments set forth herein. Like reference numerals may refer to like elements throughout this application.

FIG. 1 is a block diagram illustrating a display apparatus according to exemplary embodiments of the present inventive concept.

Referring to FIG. 1, a display apparatus 10 includes a display panel 100, a timing controller 200, a gate driver 300 and a data driver 400.

The display panel 100 operates (e.g., displays an image) based on output image data DAT. The display panel 100 is connected to a plurality of gate lines GL and a plurality of data lines DL. The gate lines GL may extend in a first direction DR1, and the data lines DL may extend in a second direction DR2 crossing (e.g., substantially perpendicular to) the first direction DR1. The display panel 100 may include a plurality of pixels PX that are arranged in a matrix form.

Each pixel may be electrically connected to a respective one of the gate lines GL and a respective one of the data lines DL.

The timing controller 200 controls operations of the display panel 100, the gate driver 300 and the data driver 400. The timing controller 200 receives input image data IDAT and an input control signal ICONT from an external device (e.g., a host or a graphic processor). The input image data IDAT may include a plurality of pixel data for the plurality of pixels PX. The input control signal ICONT may include a master clock signal, a data enable signal, a vertical synchronization signal, a horizontal synchronization signal, etc.

The timing controller 200 generates the output image data DAT based on the input image data IDAT. The timing controller 200 generates a first control signal GCONT based on the input control signal ICONT. The first control signal GCONT may be provided to the gate driver 300, and a driving timing of the gate driver 300 may be controlled based on the first control signal GCONT. The first control signal GCONT may include a vertical start signal, a gate clock signal, etc. The timing controller 200 generates a second control signal DCONT and a clock signal CLK based on the input control signal ICONT. The second control signal DCONT and the clock signal CLK may be provided to the data driver 400, and a driving timing of the data driver 400 may be controlled based on the second control signal DCONT and the clock signal CLK. The second control signal DCONT may include a horizontal start signal, a polarity control signal, a data load signal, etc. The clock signal CLK may be a data clock signal.

In exemplary embodiments of the present inventive concept, the timing controller 200 may provide the clock signal CLK and the output image data DAT that are separated from each other to the data driver 400. In exemplary embodiments of the present inventive concept, the timing controller 200 may provide a clock embedded data signal CEDS that is generated by combining the clock signal CLK with the output image data DAT to the data driver 400. In other words, the clock embedded data signal CEDS may include the clock signal CLK and the output image data DAT.

The gate driver 300 generates a plurality of gate signals for driving the gate lines GL based on the first control signal GCONT. The gate driver 300 may sequentially provide the gate signals to the gate lines GL.

The data driver 400 generates a plurality of data voltages (e.g., analog voltages) based on the output image data DAT (e.g., digital data), the clock signal CLK and the second control signal DCONT, or based on the clock embedded data signal CEDS and the second control signal DCONT. The data driver 400 may sequentially provide the data voltages to the data lines DL.

In exemplary embodiments of the present inventive concept, the gate driver 300 and/or the data driver 400 may be disposed, e.g., directly mounted, on the display panel 100, or may be connected to the display panel 100 in a tape carrier package (TCP) type. In addition, the gate driver 300 and/or the data driver 400 may be integrated on the display panel 100.

In the display apparatus 10 according to exemplary embodiments of the present inventive concept, the timing controller 200 may control at least one of an output differential voltage ("VOD"), a slew rate and toggling of the clock embedded data signal CEDS or the clock signal CLK. In addition, the timing controller 200 may further control at least one of the VOD and the slew rate of the clock embedded data signal CEDS or the clock signal CLK based on whether an image displayed on the display panel 100 is a static image (e.g., a still image, a stopped image, a photograph, etc.).

Hereinafter, an operation of the display apparatus 10 according to an exemplary embodiment of the present inventive concept will be described in detail based on the clock embedded data signal CEDS or the clock signal CLK.

Figure 2:
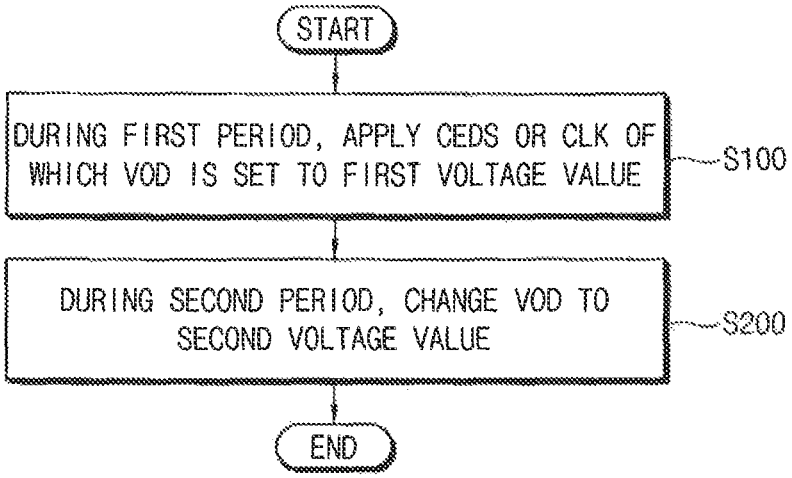
FIG. 2 is a flow chart illustrating a method of operating a display apparatus according to exemplary embodiments of the present inventive concept.

FIG. 2 is a flow chart illustrating a method of operating a display apparatus according to exemplary embodiments of the present inventive concept.

Referring to FIGS. 1 and 2, in a method of operating the display apparatus 10, during a first period, a clock embedded data signal CEDS or a clock signal CLK of which a VOD is set to a first voltage value is applied to the data driver 400 (step S100). In other words, during the first period, the timing controller 200 may set (or determine) the VOD of the clock embedded data signal CEDS or the VOD of the clock signal CLK to the first voltage value, and then, may apply the clock embedded data signal CEDS or the clock signal CLK to the data driver 400. The first period may be a duration in which output image data DAT is provided to the data driver 400.

The VOD of the clock embedded data signal CEDS or the VOD of the clock signal CLK may be a voltage difference between a first level and a second level of the clock embedded data signal CEDS or the clock signal CLK. For example, the first level may be a high level (e.g., a high voltage level) or a top level (e.g., a top voltage level), and the second level may be a low level (e.g., a low voltage level) or a bottom level (e.g., a bottom voltage level).

During a second period, the VOD of the clock embedded data signal CEDS or the VOD of the clock signal CLK that is applied to the data driver 400 is changed to a second voltage value (step S200). The second voltage value is smaller than the first voltage value. In other words, during the second period, the timing controller 200 may reduce (or decrease) the VOD of the clock embedded data signal CEDS or the VOD of the clock signal CLK to the second voltage value, and then, may apply the clock embedded data signal CEDS or the clock signal CLK to the data driver 400. The second period may be a duration in which the output image data DAT is not provided to the data driver 400.

In exemplary embodiments of the present inventive concept, the second period may include a first blank period disposed between two consecutive frame periods for displaying two consecutive frame images. For example, the display panel 100 may sequentially display a plurality of frame images based on the output image data DAT provided to the data driver 400, and each frame image may be displayed on the display panel 100 during a respective one frame period. In each frame period, real image data for a respective one frame image may be provided to the data driver 400. However, in a time between two consecutive frame periods, the real image data may not be provided to the data driver 400. Here, non-real image data (e.g., dummy data) may be provided to the data driver 400. This time between two consecutive frame periods may be referred to as a vertical blank period. The first blank period may be substantially the same as the vertical blank period. A single frame period between two vertical blank periods may be referred to as a vertical active period.

In exemplary embodiments of the present inventive concept, the second period may include a second blank period disposed between two consecutive line periods for displaying two consecutive line images in one frame image. For example, the display panel 100 may include a plurality of lines (e.g., horizontal lines) each of which corresponds to a single pixel row (or a single pixel column). Based on the output image data DAT provided to the data driver 400, each line in the display panel 100 may display a respective one line image, and the display panel 100 may display one frame image based on a plurality of line images displayed on the plurality of lines. Each line image may be displayed on a respective one line during a respective one line period and may maintain the displayed image during a respective one frame period including the respective one line period. In each line period, real image data for a respective one line image may be provided to the data driver 400. However, in a time between two consecutive line periods, the real image data may not be provided to the data driver 400. Here, non-real image data may be provided to the data driver 400. This time between two consecutive line periods may be referred to as a horizontal blank period. The second blank period may be substantially the same as the horizontal blank period. A single line period between two horizontal blank periods may be referred to as a horizontal active period.

In exemplary embodiments of the present inventive concept, the second period may include both the first blank period and the second blank period.

The first period may include periods different than the second period. For example, the first period may include at least one of the frame periods (e.g., the vertical active periods) and/or at least one of the line periods (e.g., the horizontal active periods). In other words, the first period may represent a duration for displaying the frame image and/or the line image on the display panel 100 and may represent a duration for charging the plurality of pixels PX based on the output image data DAT.

In the method of operating the display apparatus 10 according to exemplary embodiments of the present inventive concept, the VOD of the clock embedded data signal CEDS or the VOD of the clock signal CLK may be reduced during the second period in which the output image data DAT is not provided to the data driver 400. Accordingly, harmonic noise caused by the clock embedded data signal CEDS or the clock signal CLK in the display apparatus 10 may be reduced without having to change a frequency of the clock embedded data signal CEDS or the clock signal CLK. Consequently, the display apparatus 10 may have reduced power consumption.

Figure 3:
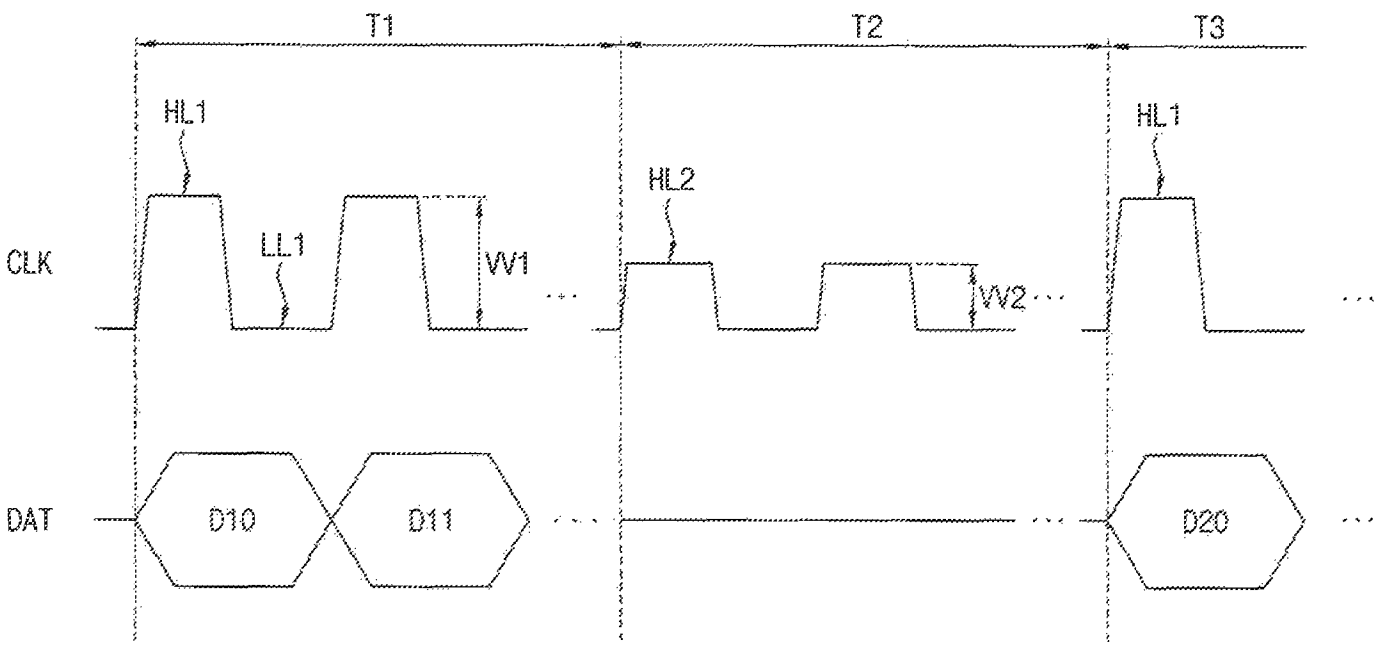
FIG. 3 is a timing diagram for describing the method of operating the display apparatus according to exemplary embodiments of the present inventive concept.

FIG. 3 is a timing diagram for describing the method of operating the display apparatus according to exemplary embodiments of the present inventive concept.

Referring to FIGS. 2 and 3, each of periods T1 and T3 may correspond to the first period, and a period T2 may correspond to the second period. For example, the periods T1, T2 and T3 may represent a first vertical active period, a first vertical blank period and a second vertical active period, respectively. As another example, the periods T1, T2 and T3 may represent a first horizontal active period, a first horizontal blank period and a second horizontal active period, respectively.

In the period T1 of FIG. 3, output image data DAT is provided to the data driver 400. Here, the output image data DAT includes data bits D10 and D11. A clock signal CLK having a VOD set to a first voltage value VV1 is applied to the data driver 400. For example, the clock signal CLK may toggle or swing between a first high level HL1 and a first low level LL1 during the period T1.

In the period T2 of FIG. 3 after the period T1, the output image data DAT is not provided to the data driver 400, and thus, the output image data DAT does not include any data bits. The VOD of the clock signal CLK is changed from the first voltage value VV1 to a second voltage value VV2, and then, the clock signal CLK having the reduced VOD is applied to the data driver 400. For example, the clock signal CLK may toggle or swing between a second high level HL2 and the first low level LL1 during the period T2. The second high level HL2 may have a voltage level lower than that of the first high level HL1.

In exemplary embodiments of the present inventive concept, the second voltage value VV2 may be equal to or greater than approximately 30% of the first voltage value VV1 and may be equal to or smaller than approximately 80% of the first voltage value VV1. More particularly, the second voltage value VV2 may be equal to or greater than approximately 50% of the first voltage value VV1 and may be equal to or smaller than approximately 75% of the first voltage value VV1. For example, when the first voltage value VV1 is about 500 millivolt (mV), the second voltage value VV2 may be equal to or greater than about 150 mV and equal to or smaller than about 400 mV, and more particularly, equal to or greater than about 250 mV and equal to or smaller than about 375 mV. If the second voltage value VV2 is less than approximately 30% of the first voltage value VV1, display quality of the display panel 100 may be degraded, and/or the display apparatus 10 may not normally operate. If the second voltage value VV2 is greater than approximately 80% of the first voltage value VV1, it may cause a small amount of the harmonic noise to be reduced.

In exemplary embodiments of the present inventive concept, the first voltage value VV1 may be equal to or greater than about 130 mV and may be equal to or smaller than about 700 mV. The second voltage value VV2 may be equal to or greater than about 75 mV and may be equal to or smaller than about 500 mV. For example, the first voltage value VV1 may be set to about 130 mV, 250 mV, 350 mV, 480 mV, 600 mV or 700 mV, and the second voltage value VV2 may be respectively set to about 75 mV, 150 mV, 250 mV, 320 mV, 400 mV or 500 mV. However, the first voltage value VV1 and the second voltage value VV2 are not limited thereto, and may be changed according to exemplary embodiments of the present inventive concept.

An operation in the period T3 of FIG. 3 after the period T2 may be substantially the same as an operation in the period T1 of FIG. 3. For example, in the period T3 of FIG. 3, the output image data DAT is provided to the data driver 400, and thus, the output image data DAT includes a data bit D20. The VOD of the clock signal CLK is set to the first voltage value VV1 again (e.g., it is changed from the second voltage value VV2 back to the first voltage value VV1), and then, the clock signal CLK having the increased VOD is applied to the data driver 400.

A blank period that is substantially the same as the period T2 and an active period that is substantially the same as the period T1 may be alternately repeated after the period T3. A frequency of the clock signal CLK may be substantially fixed during all periods T1, T2 and T3.

Figure 4:
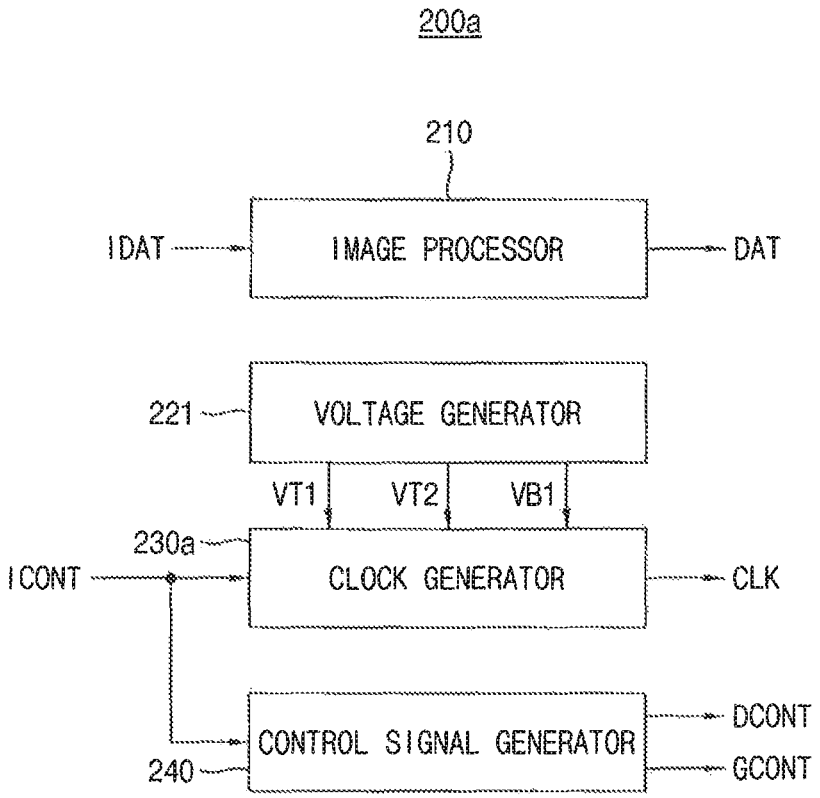
FIG. 4 is a block diagram illustrating a timing controller included in the display apparatus according to exemplary embodiments of the present inventive concept.
Figure 5A:
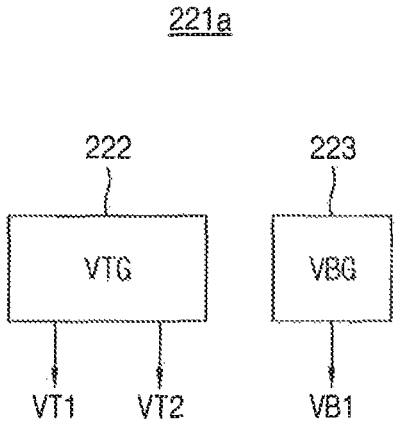
FIGS. 5A and 5B are block diagrams illustrating a voltage generator included in the timing controller of FIG. 4 according to exemplary embodiments of the present inventive concept.
Figure 5B:
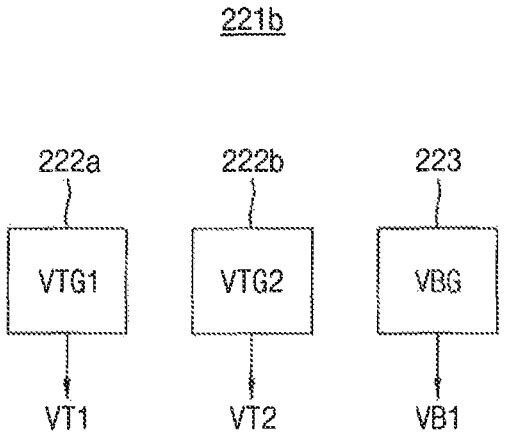

FIG. 4 is a block diagram illustrating a timing controller included in the display apparatus according to exemplary embodiments of the present inventive concept. FIGS. 5A and 5B are block diagrams illustrating a voltage generator included in the timing controller of FIG. 4 according to exemplary embodiments of the present inventive concept.

Referring to FIGS. 4, 5A and 5B, a timing controller 200*a* may include an image processor 210, a voltage generator 221, a clock generator 230*a* and a control signal generator 240. The timing controller 200*a* of FIG. 4 may generate the clock signal CLK illustrated in FIG. 3. The timing controller 200*a* is illustrated in FIG. 4 as being divided into four elements for convenience of explanation, however, the timing controller 200*a* may not be physically divided as shown.

The image processor 210 may generate the output image data DAT by performing at least one image processing on the input image data IDAT. For example, the image processor 210 may selectively perform an image quality compensation, a spot compensation, an adaptive color correction (ACC), and/or a dynamic capacitance compensation (DCC) on the input image data IDAT to generate the output image data DAT.

The voltage generator 221 may generate a first high voltage (or a first top voltage) VT1, a second high voltage (or a second top voltage) VT2 and a first low voltage (or a bottom voltage) VB1 for generating the clock signal CLK. The second high voltage VT2 may have a level lower than that of the first high voltage VT1. For example, the first high voltage VT1 may have the first high level HL1 as shown in FIG. 3, the second high voltage VT2 may have the second high level HL2 as shown in FIG. 3, and the first low voltage VB1 may have the first low level LL1 as shown in FIG. 3.

In exemplary embodiments of the present inventive concept, the voltage generator 221 may be a voltage generator 221*a* of FIG. 5A. The voltage generator 221*a* may include a high voltage generator 222 and a low voltage generator 223. The high voltage generator 222 may generate the first and second high voltages VT1 and VT2. The low voltage generator 223 may generate the first low voltage VB1.

In exemplary embodiments of the present inventive concept, the voltage generator 221 may be a voltage generator 221*b* of FIG. 5B. The voltage generator 221*b* may include a first high voltage generator 222*a*, a second high voltage generator 222*b* and a low voltage generator 223. The first high voltage generator 222*a* may generate the first high voltage VT1. The second high voltage generator 222*b* may generate the second high voltage VT2. The low voltage generator 223 may generate the first low voltage VB1.

The clock generator 230*a* may generate the clock signal CLK based on the input control signal ICONT and the plurality of voltages VT1, VT2 and VB1 generated by the voltage generator 221. For example, the clock generator 230*a* may output the clock signal CLK based on the input control signal ICONT, the first high voltage VT1 and the first low voltage VB1 during the first period. The clock generator 230*a* may output the clock signal CLK based on the input control signal ICONT, the second high voltage VT2 and the first low voltage VB1 during the second period.

In other words, during the first period, the clock generator 230*a* may set the VOD of the clock signal CLK to the first voltage value (e.g., VV1 in FIG. 3) based on the first high voltage VT1 and the first low voltage VB1. A difference between the first high voltage VT1 and the first low voltage VB1 may be substantially equal to the first voltage value VV1. During the second period, the clock generator 230*a* may change the VOD of the clock signal CLK to the second voltage value (e.g., VV2 in FIG. 3) based on the second high voltage VT2 and the first low voltage VB1. A difference between the second high voltage VT2 and the first low voltage VB1 may be substantially equal to the second voltage value VV2.

The control signal generator 240 may generate the first control signal GCONT and the second control signal DCONT based on the input control signal ICONT.

Figure 6:
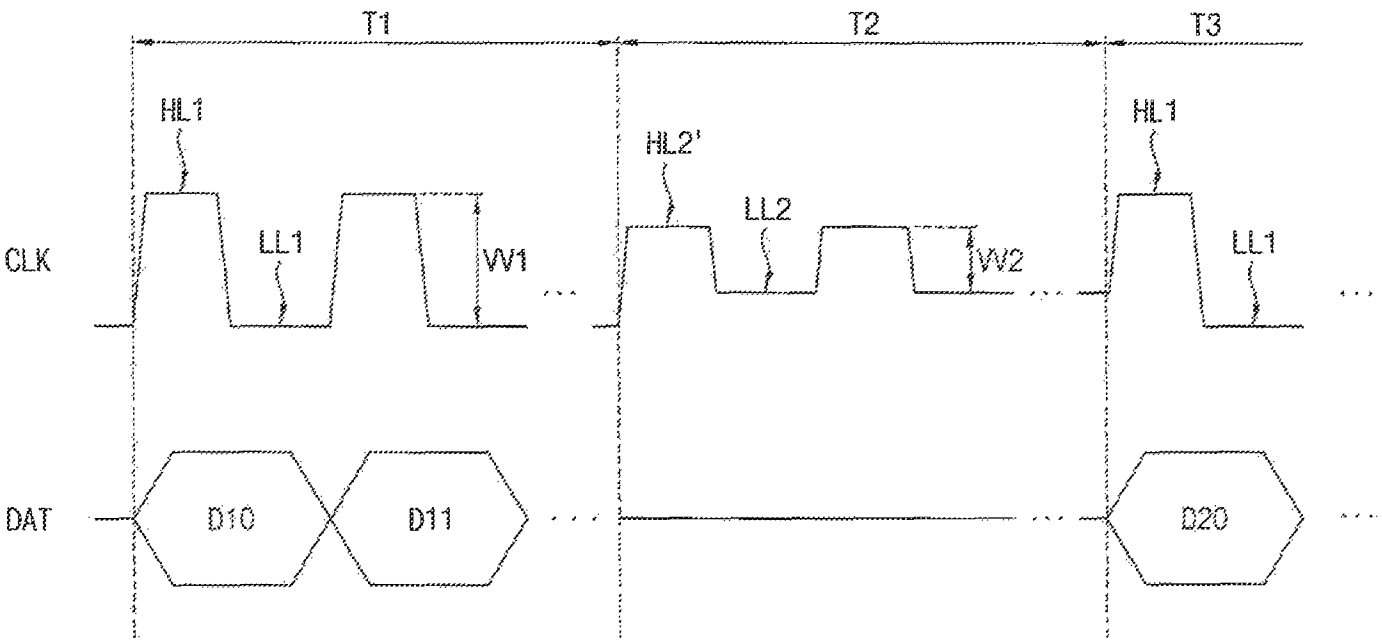
FIG. 6 is a timing diagram for describing the method of operating the display apparatus according to exemplary embodiments of the present inventive concept.

FIG. 6 is a timing diagram for describing the method of operating the display apparatus according to exemplary embodiments of the present inventive concept.

Referring to FIGS. 2 and 3, periods T1, T2 and T3 in FIG. 6 may be substantially the same as the periods T1, T2 and T3 in FIG. 3, respectively. A timing diagram of FIG. 6 may be substantially the same as a timing diagram of FIG. 3, except that a voltage level of a clock signal CLK in the period T2 of FIG. 6 is different from a voltage level of the clock signal CLK in the period T2 of FIG. 3.

An operation in the period T1 of FIG. 6 may be substantially the same as the operation in the period T1 of FIG. 3.

In the period T2 of FIG. 6 after the period T1, the output image data DAT is not provided to the data driver 400, the VOD of the clock signal CLK is changed from a first voltage value VV1 to a second voltage value VV2, and then, the clock signal CLK having the reduced VOD is applied to the data driver 400. For example, the clock signal CLK may toggle or swing between a second high level HL2' and a second low level LL2 during the period T2. The second high level HL2' may have a voltage level lower than that of a first high level HL1 of period T1 of FIG. 6, and the second low level LL2 may have a voltage level higher than that of a first low level LL1 of period T1 of FIG. 6.

An operation in the period T3 of FIG. 6 after the period T2 may be substantially the same as the operation in the period T1 of FIG. 6. A blank period and an active period may be alternately repeated after the period T3. A frequency of the clock signal CLK may not be changed and may be substantially fixed.

Figure 7:
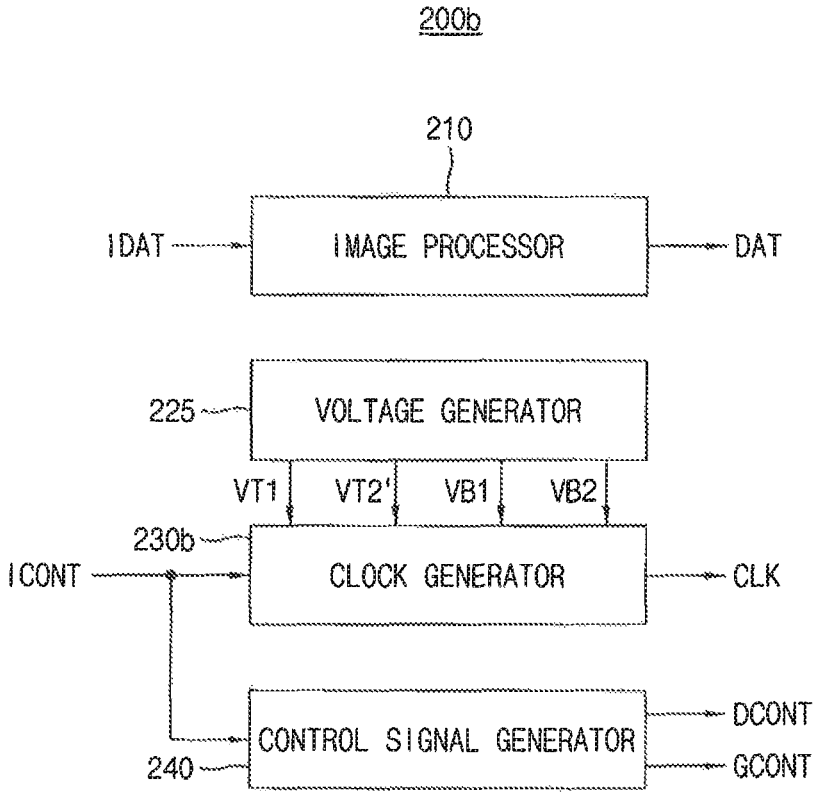
FIG. 7 is a block diagram illustrating a timing controller included in the display apparatus according to exemplary embodiments of the present inventive concept.
Figure 8A:
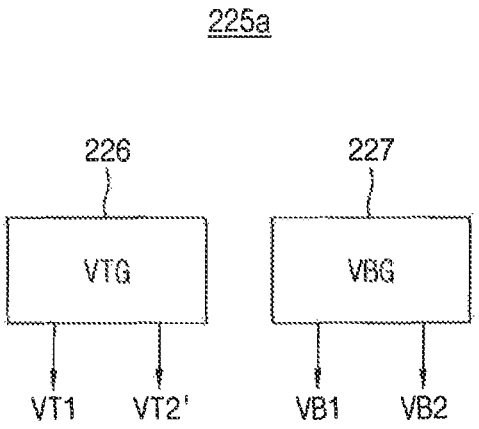
FIGS. 8A and 8B are block diagrams illustrating a voltage generator included in the timing controller of FIG. 7 according to exemplary embodiments of the present inventive concept.
Figure 8B:
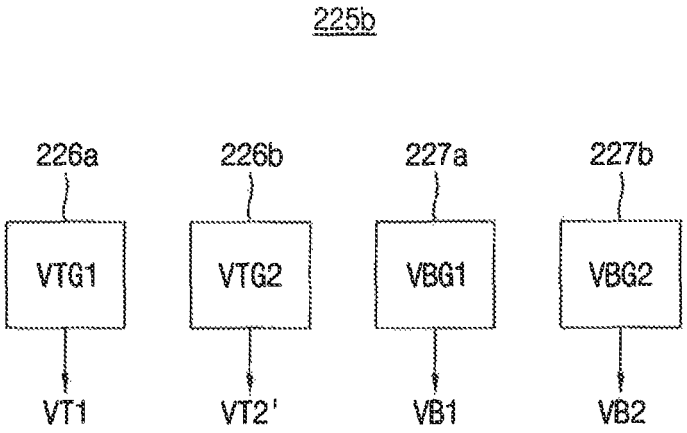

FIG. 7 is a block diagram illustrating a timing controller included in the display apparatus according to exemplary embodiments of the present inventive concept. FIGS. 8A and 8B are block diagrams illustrating a voltage generator included in the timing controller of FIG. 7 according to exemplary embodiments of the present inventive concept.

Referring to FIGS. 7, 8A and 8B, a timing controller 200*b* may include an image processor 210, a voltage generator 225, a clock generator 230*b* and a control signal generator 240. The timing controller 200*b* of FIG. 7 may generate the clock signal CLK illustrated in FIG. 6.

The image processor 210 and the control signal generator 240 in FIG. 7 may be substantially the same as the image processor 210 and the control signal generator 240 in FIG. 4, respectively.

The voltage generator 225 may generate a first high voltage VT1, a second high voltage VT2', a first low voltage VB1 and a second low voltage VB2 for generating the clock signal CLK. The second high voltage VT2' may have a level lower than that of the first high voltage VT1. The second low voltage VB2 may have a level higher than that of the first low voltage VB1. For example, the first high voltage VT1 may have the first high level HL1 in FIG. 6, the second high voltage VT2' may have the second high level HL2' in FIG. 6, the first low voltage VB1 may have the first low level LL1 in FIG. 6, and the second low voltage VB2 may have the second low level LL2 in FIG. 6.

In exemplary embodiments of the present inventive concept, the voltage generator 225 may be a voltage generator 225*a* of FIG. 8A. The voltage generator 225*a* may include a high voltage generator 226 and a low voltage generator 227. The high voltage generator 226 may generate the first and second high voltages VT1 and VT2'. The low voltage generator 227 may generate the first and second low voltages VB1 and VB2.

In exemplary embodiments of the present inventive concept, the voltage generator 225 may be a voltage generator 225*b* of FIG. 8B. The voltage generator 225*b* may include a first high voltage generator 226*a*, a second high voltage generator 226*b*, a first low voltage generator 227*a* and a second low voltage generator 227*b*. The first high voltage generator 226*a* may generate the first high voltage VT1. The second high voltage generator 226*b* may generate the second high voltage VT2'. The first low voltage generator 227*a* may generate the first low voltage VB1. The second low voltage generator 227*b* may generate the second low voltage VB2.

In exemplary embodiments of the present inventive concept, the voltage generator 225 may include the high voltage generator 226 in FIG. 8A and the first and second low voltage generators 227*a* and 227*b* in FIG. 8B, or the voltage generator 225 may include the low voltage generator 227 in FIG. 8A and the first and second high voltage generators 226*a* and 226*b* in FIG. 8B.

The clock generator 230*b* may generate the clock signal CLK based on the input control signal ICONT and the plurality of voltages VT1, VT2', VB1 and VB2 generated by the voltage generator 225. For example, the clock generator 230*b* may output the clock signal CLK having the VOD of the first voltage value (e.g., VV1 in FIG. 6) based on the input control signal ICONT, the first high voltage VT1 and the first low voltage VB1 during the first period. A difference between the first high voltage VT1 and the first low voltage VB1 may be substantially equal to the first voltage value VV1. The clock generator 230*b* may output the clock signal CLK having the VOD of the second voltage value (e.g., VV2 in FIG. 6) based on the input control signal ICONT, the second high voltage VT2' and the second low voltage VB2 during the second period. A difference between the second high voltage VT2' and the second low voltage VB2 may be substantially equal to the second voltage value VV2.

Figure 9:
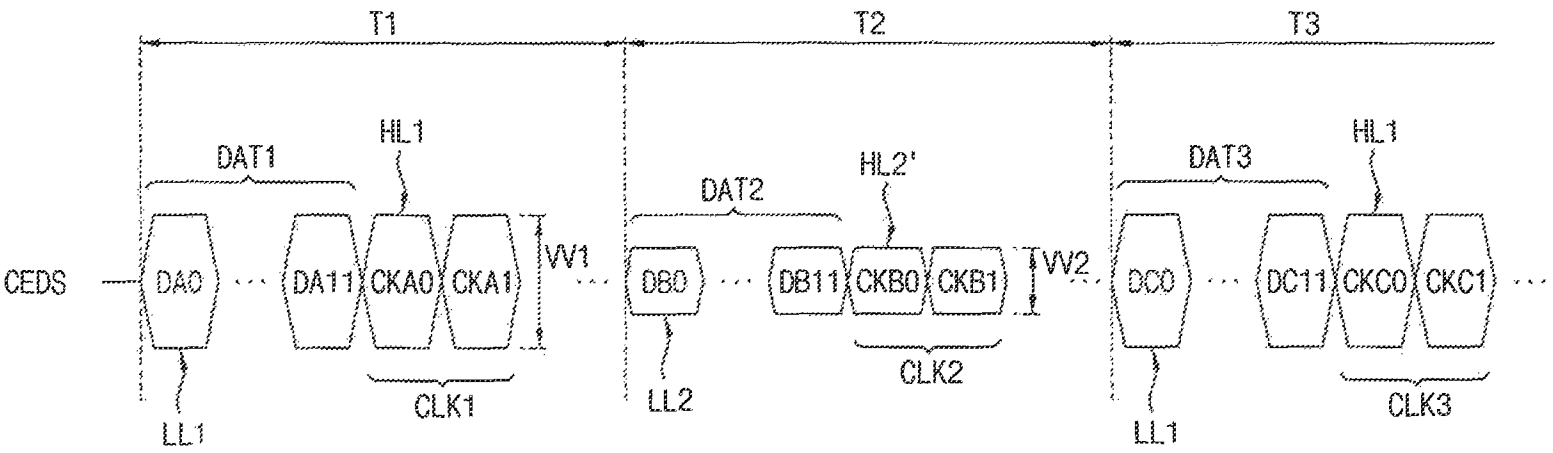
FIG. 9 is a timing diagram for describing a method of operating the display apparatus according to exemplary embodiments of the present inventive concept.

FIG. 9 is a timing diagram for describing a method of operating the display apparatus according to exemplary embodiments of the present inventive concept.

Referring to FIGS. 2 and 9, each of periods T1 and T3 may correspond to the first period, and a period T2 may correspond to the second period. In an example of FIG. 9, a clock signal CLK and output image data DAT may be combined to form a clock embedded data signal CEDS, and then, the clock embedded data signal CEDS may be provided to the data driver 400.

In the period T1 of FIG. 9, the output image data DAT is provided to the data driver 400 as part of the clock embedded data signal CEDS. The clock embedded data signal CEDS includes bits DA0~DA11 of first data DAT1 and bits CKA0 and CKA1 of first clock data CLK1. The first data DAT1 may be a part of the output image data DAT, and the first clock data CLK1 may be a part of the clock signal CLK. The clock embedded data signal CEDS of which a VOD is set to a first voltage value VV1 is applied to the data driver 400. For example, the clock embedded data signal CEDS may toggle or swing between a first high level HL1 and a first low level LL1 during the period T1.

In exemplary embodiments of the present inventive concept, bits included in the clock embedded data signal CEDS may be arranged based on a predetermined pattern. For example, the predetermined pattern may be repeated arrangements, each arrangement including two 6-bit pixel data (e.g., the first data DAT including twelve bits) and one 2-bit clock data (e.g., the first clock data CLK1 including two bits). For example, 12 bits of first data and 2 bits of clock data, then another 12 bits of first data and another 2 bits of clock data.

In the period T2 of FIG. 9 after the period T1, the output image data DAT is not provided to the data driver 400, and the clock embedded data signal CEDS includes bits DB0~DB11 of second data DAT2 and bits CKB0 and CKB1 of second clock data CLK2. The second data DAT2 does not correspond to image data. In other words, the second data DAT2 is not image data. For example, the second data DAT2 may be dummy data irrelevant to image data. The second clock data CLK2 may be a part of the clock signal CLK. The VOD of the clock embedded data signal CEDS is changed from the first voltage value VV1 to a second voltage value VV2, and then, the clock embedded data signal CEDS having the reduced VOD is applied to the data driver 400. For example, the clock embedded data signal CEDS may toggle or swing between a second high level HL2' and a second low level LL2 during the period T2.

An operation in the period T3 of FIG. 9 after the period T2 may be substantially the same as an operation in the period T1 of FIG. 9. For example, in the period T3, the output image data DAT is provided to the data driver 400, and the clock embedded data signal CEDS includes bits DC0~DC11 of third data DAT3 and bits CKC0 and CKC1 of third clock data CLK3. The third data DAT3 may be a part of the output image data DAT, and the third clock data CLK3 may be a part of the clock signal CLK. The VOD of the clock embedded data signal CEDS is set to the first voltage value VV1 again (e.g., it is changed from the second voltage value VV2 back to the first voltage value VV1), and then, the clock embedded data signal CEDS having the increased VOD is applied to the data driver 400.

A blank period and an active period may be alternately repeated after the period T3. A frequency of the clock embedded data signal CEDS may not be changed and may be substantially fixed.

Figure 10:
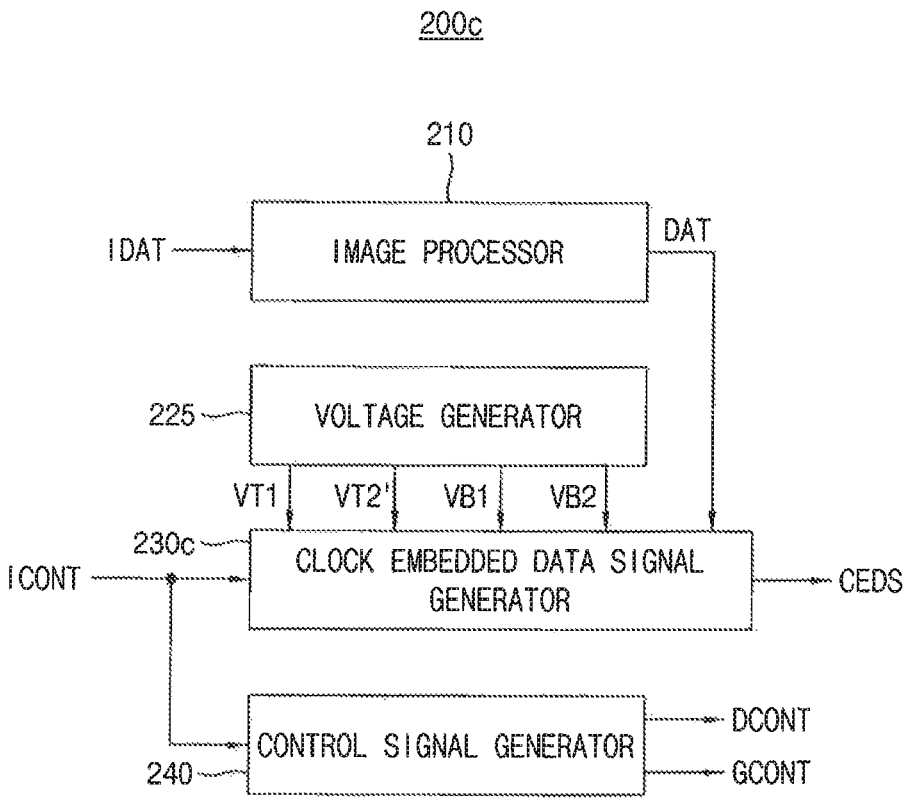
FIG. 10 is a block diagram illustrating a timing controller included in the display apparatus according to exemplary embodiments of the present inventive concept.

FIG. 10 is a block diagram illustrating a timing controller included in the display apparatus according to exemplary embodiments of the present inventive concept.

Referring to FIG. 10, a timing controller 200*c* may include an image processor 210, a voltage generator 225, a clock embedded data signal generator 230*c* and a control signal generator 240. The timing controller 200*c* of FIG. 10 may generate the clock embedded data signal CEDS illustrated in FIG. 9.

The image processor 210, the voltage generator 225 and the control signal generator 240 in FIG. 10 may be substantially the same as the image processor 210, the voltage generator 225 and the control signal generator 240 in FIG. 7, respectively.

The clock embedded data signal generator 230*c* may generate the clock embedded data signal CEDS based on the input control signal ICONT, the output image data DAT and the plurality of voltages VT1, VT2', VB1 and VB2 generated by the voltage generator 225. The clock embedded data signal CEDS may be generated by combining the clock signal CLK with the output image data DAT. For example, the clock embedded data signal generator 230*c* may output the clock embedded data signal CEDS having the VOD of the first voltage value (e.g., VV1 in FIG. 9) based on the input control signal ICONT, the output image data DAT, the first high voltage VT1 and the first low voltage VB1 during the first period. The clock embedded data signal generator 230*c* may output the clock embedded data signal CEDS having the VOD of the second voltage value (e.g., VV2 in FIG. 9) based on the input control signal ICONT, the output image data DAT, the second high voltage VT2' and the second low voltage VB2 during the second period.

When the timing controller 200*c* is configured to generate the clock embedded data signal CEDS, the data driver 400 may include an element that divides the clock embedded data signal CEDS into the clock signal CLK and the output image data DAT. For example, the data driver 400 may include a clock recoverer that detects a clock signal from the clock embedded data signal CEDS based on a clock window determined by a clock training operation and delays the clock embedded data signal CEDS based on the clock signal to detect image data.

Figure 11:
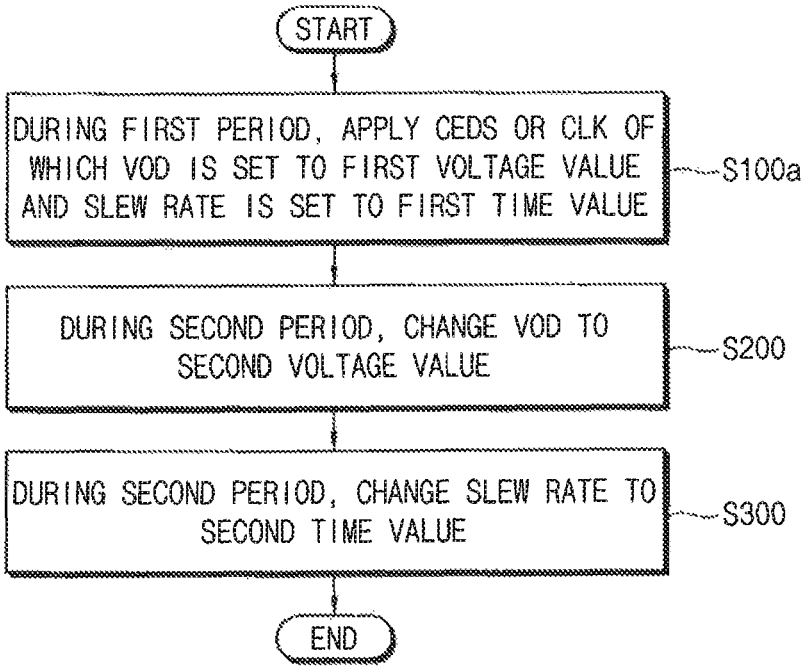
FIG. 11 is a flow chart illustrating a method of operating a display apparatus according to exemplary embodiments of the present inventive concept.

FIG. 11 is a flow chart illustrating a method of operating a display apparatus according to exemplary embodiments of the present inventive concept.

Referring to FIGS. 1 and 11, in a method of operating the display apparatus 10, during a first period, a clock embedded data signal CEDS or a clock signal CLK having a VOD set to a first voltage value and a slew rate set to a first time value is applied to the data driver 400 (step S100*a*). Step S100*a* in FIG. 11 may be substantially the same as step S100 in FIG. 2. For example, the timing controller 200 may further set the slew rate of the clock embedded data signal CEDS or the slew rate of the clock signal CLK to the first time value in step S100 of FIG. 2. In setting the slew rates of the clock embedded data signal CEDS and the clock signal CLK, the timing controller 200 may first determine these slew rates.

The slew rate of the clock embedded data signal CEDS or the slew rate of the clock signal CLK is a time required to transition from one of a first level (e.g., a high level) and a second level (e.g., a low level) of the clock embedded data signal CEDS or the clock signal CLK to the other of the first level and the second level of the clock embedded data signal CEDS or the clock signal CLK. For example, in the following, VL represents a low level of the clock embedded data signal CEDS or the clock signal CLK, and VD represents a difference between a high level and the low level of the clock embedded data signal CEDS or the clock signal CLK. In this case, the slew rate of the clock embedded data signal CEDS or the slew rate of the clock signal CLK may correspond to a time required to transition from a level of (VL+0.2*VD) to a level of (VL+0.8*VD) in a rising edge of the clock embedded data signal CEDS or the clock signal CLK. In addition, the slew rate of the clock embedded data signal CEDS or the slew rate of the clock signal CLK may also correspond to a time required to transition from the level of (VL+0.8*VD) to the level of (VL+0.2*VD) in a falling edge of the clock embedded data signal CEDS or the clock signal CLK. In other words, the slew rate of the clock embedded data signal CEDS or the slew rate of the clock signal CLK may be associated with a rising transition time and a falling transition time of the clock embedded data signal CEDS or the clock signal CLK.

During a second period, the VOD of the clock embedded data signal CEDS or the VOD of the clock signal CLK that is applied to the data driver 400 is changed to a second voltage value smaller than the first voltage value (step S200). Step S200 in FIG. 11 may be substantially the same as step S200 in FIG. 2. In addition, during the second period, the slew rate of the clock embedded data signal CEDS or the slew rate of the clock signal CLK may be changed to a second time value (step S300). The second time value may be greater than the first time value.

In other words, during the second period, the timing controller 200 may reduce (or decrease) the VOD of the clock embedded data signal CEDS or the VOD of the clock signal CLK to the second voltage value, may increase the slew rate of the clock embedded data signal CEDS or the slew rate of the clock signal CLK to the second time value, and then, may apply the clock embedded data signal CEDS or the clock signal CLK to the data driver 400.

As described above with reference to FIG. 2, the first period represents a duration (e.g., an active period) in which output image data DAT is provided to the data driver 400. The second period represents a duration (e.g., a blank period) in which the output image data DAT is not provided to the data driver 400.

In the method of operating the display apparatus 10 according to exemplary embodiments of the present inventive concept, the VOD of the clock embedded data signal CEDS or the VOD of the clock signal CLK may be reduced, and the slew rate of the clock embedded data signal CEDS or the slew rate of the clock signal CLK may be further controlled, during the second period in which the output image data DAT is not provided to the data driver 400. Accordingly, harmonic noise caused by the clock embedded data signal CEDS or the clock signal CLK in the display apparatus 10 may be reduced without having to change a frequency of the clock embedded data signal CEDS or the clock signal CLK. In addition, the display apparatus 10 may have reduced power consumption.

Figure 12:
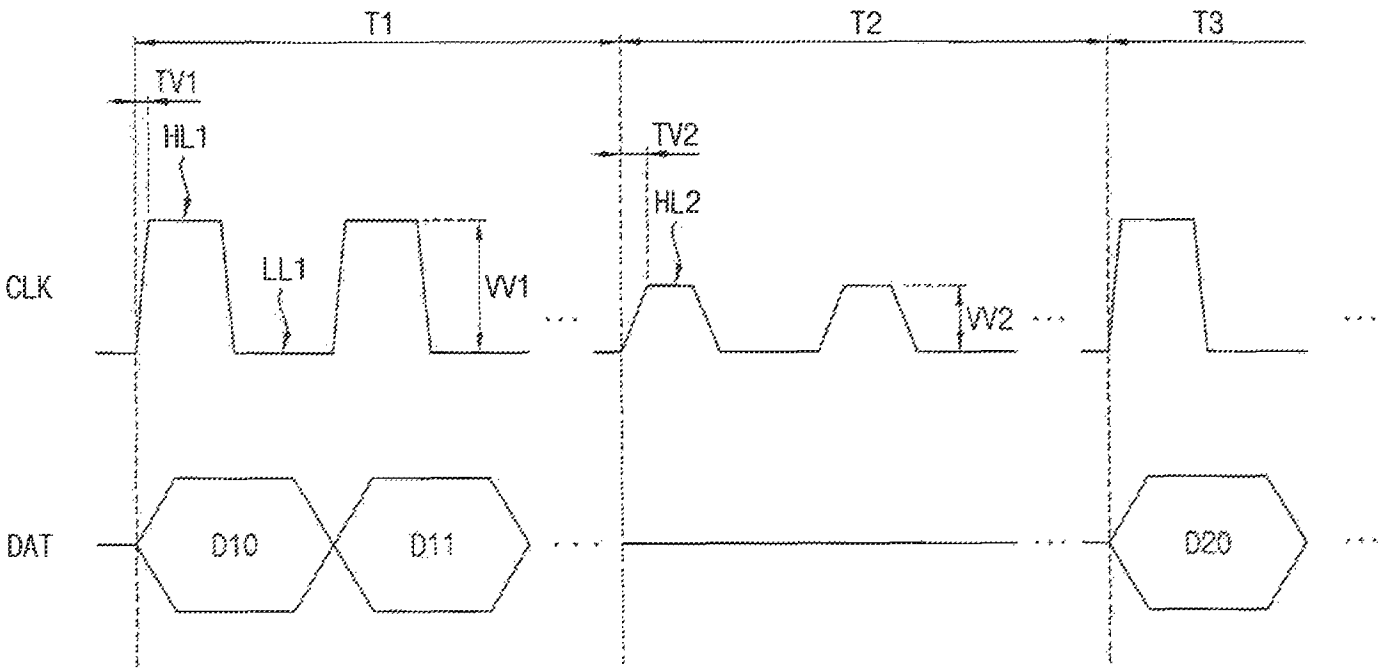
FIGS. 12 and 13 are timing diagrams for describing a method of operating the display apparatus according to exemplary embodiments of the present inventive concept.
Figure 13:
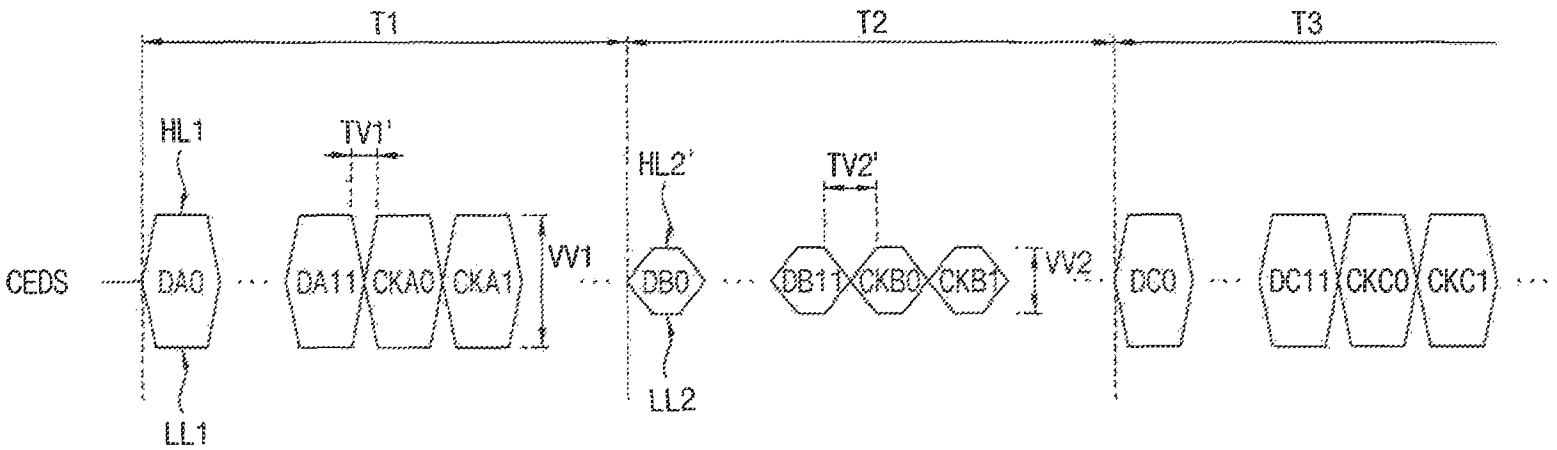

FIGS. 12 and 13 are timing diagrams for describing a method of operating the display apparatus according to exemplary embodiments of the present inventive concept.

Referring to FIGS. 11 and 12, periods T1, T2 and T3 in FIG. 12 may be substantially the same as the periods T1, T2 and T3 in FIG. 3, respectively. A timing diagram of FIG. 12 may be substantially the same as a timing diagram of FIG. 3, except that a slew rate of a clock signal CLK is further changed in the period T2 of FIG. 12.

In the period T1 of FIG. 12, output image data DAT is provided to the data driver 400. The clock signal CLK having a VOD set to a first voltage value VV1 and a slew rate set to correspond to a first time value TV1 is applied to the data driver 400.

In the period T2 of FIG. 12 after the period T1, the output image data DAT is not provided to the data driver 400. The VOD of the clock signal CLK is changed from the first voltage value VV1 to a second voltage value VV2, and the slew rate of the clock signal CLK is changed to correspond to a second time value TV2. The clock signal CLK having the reduced VOD and the changed slew rate is applied to the data driver 400.

In exemplary embodiments of the present inventive concept, the second time value TV2 may be greater than the first time value TV1 and may be equal to or smaller than approximately three times the first time value TV1. For example, when the first time value TV1 is about 100 picosecond (ps), the second time value TV2 may be greater than about 100 ps and equal to or smaller than about 300 ps. If the second voltage value VV2 is greater than approximately three times the first time value TV1, a display quality of the display panel 100 may be degraded, and/or the display apparatus 10 may not normally operate.

In exemplary embodiments of the present inventive concept, each of the first time value TV1 and the second time value TV2 may be equal to or less than about 350 ps. However, the first time value TV1 and the second time value TV2 are not limited thereto, and may be changed according to exemplary embodiments of the present inventive concept.

An operation in the period T3 of FIG. 12 after the period T2 may be substantially the same as an operation in the period T1 of FIG. 12.

Referring to FIGS. 11 and 13, periods T1, T2 and T3 in FIG. 13 may be substantially the same as the periods T1, T2 and T3 in FIG. 9, respectively. A timing diagram of FIG. 13 may be substantially the same as a timing diagram of FIG. 9, except that a slew rate of a clock embedded data signal CEDS is further changed in the period T2 of FIG. 13.

In the period T1 of FIG. 13, the output image data DAT is provided to the data driver 400. The clock embedded data signal CEDS having a VOD set to a first voltage value VV1 and a slew rate set to correspond to a first time value TV1' is applied to the data driver 400.

In the period T2 of FIG. 13 after the period T1, the output image data DAT is not provided to the data driver 400. The VOD of the clock embedded data signal CEDS is changed from the first voltage value VV1 to a second voltage value VV2, and the slew rate of the clock embedded data signal CEDS is changed to correspond to a second time value TV2'. The clock embedded data signal CEDS having the reduced VOD and the changed slew rate is applied to the data driver 400.

An operation in the period T3 of FIG. 13 after the period T2 may be substantially the same as an operation in the period T1 of FIG. 13.

In exemplary embodiments of the present inventive concept, the timing controller 200*a* of FIG. 4 may generate the clock signal CLK illustrated in FIG. 12. To generate the clock signal CLK illustrated in FIG. 12, the clock generator 230*a* in FIG. 4 may further control the slew rate of the clock signal CLK during the second period T2. The timing controller 200*c* of FIG. 10 may generate the clock embedded data signal CEDS illustrated in FIG. 13. To generate the clock embedded data signal CEDS illustrated in FIG. 13, the clock embedded data signal generator 230*c* in FIG. 10 may further control the slew rate of the clock embedded data signal CEDS during the second period T2.

When the timing controller 200*b* of FIG. 7 generates the clock signal CLK illustrated in FIG. 6, a slew rate of the clock signal CLK is further changed in the period T2 of FIG. 6. This is also applicable to the embodiments illustrated in FIGS. 12 and 13.

According to exemplary embodiments of the present inventive concept, the VOD of the clock embedded data signal CEDS or the VOD of the clock signal CLK may not be changed during the second period T2 of FIGS. 12 and 13, and the slew rate of the clock embedded data signal CEDS or the slew rate of the clock signal CLK may only be changed during the second period T2 of FIGS. 12 and 13.

Figure 14:
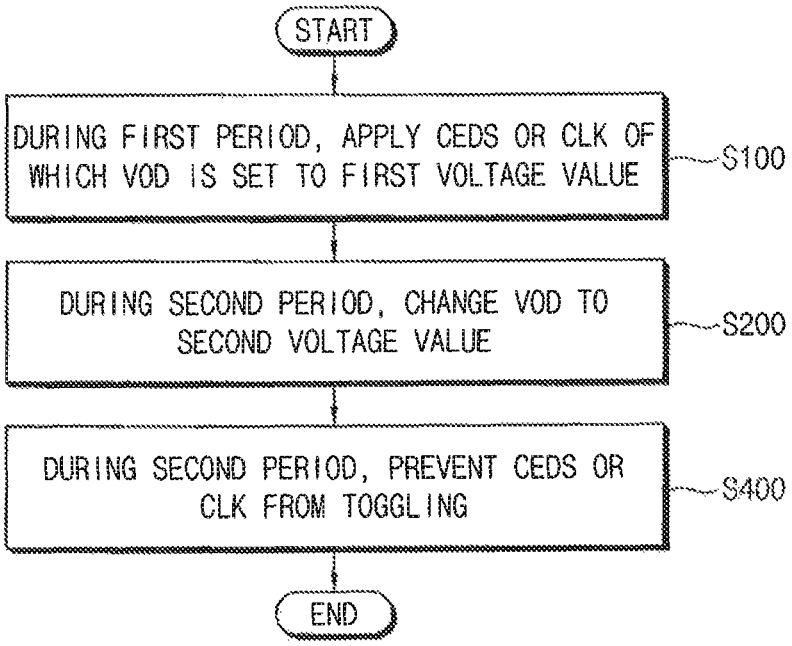
FIG. 14 is a flow chart illustrating a method of operating a display apparatus according to exemplary embodiments of the present inventive concept.

FIG. 14 is a flow chart illustrating a method of operating a display apparatus according to exemplary embodiments of the present inventive concept.

Referring to FIGS. 1 and 14, in a method of operating the display apparatus 10, during a first period, a clock embedded data signal CEDS or a clock signal CLK having a VOD set to a first voltage value is applied to the data driver 400 (step S100). During a second period, the VOD of the clock embedded data signal CEDS or the VOD of the clock signal CLK that is applied to the data driver 400 is changed to a second voltage value smaller than the first voltage value (step S200). Steps S100 and S200 in FIG. 14 may be substantially the same as steps S100 and S200 in FIG. 2, respectively.

During the second period, the clock embedded data signal CEDS or the clock signal CLK applied to the data driver 400 may be prevented from toggling (step S400). In other words, during the second period, the timing controller 200 may block (or shut off, cut off, etc.) an output of the clock embedded data signal CEDS or the clock signal CLK. In this case, step S200 may be omitted.

Figure 15A:
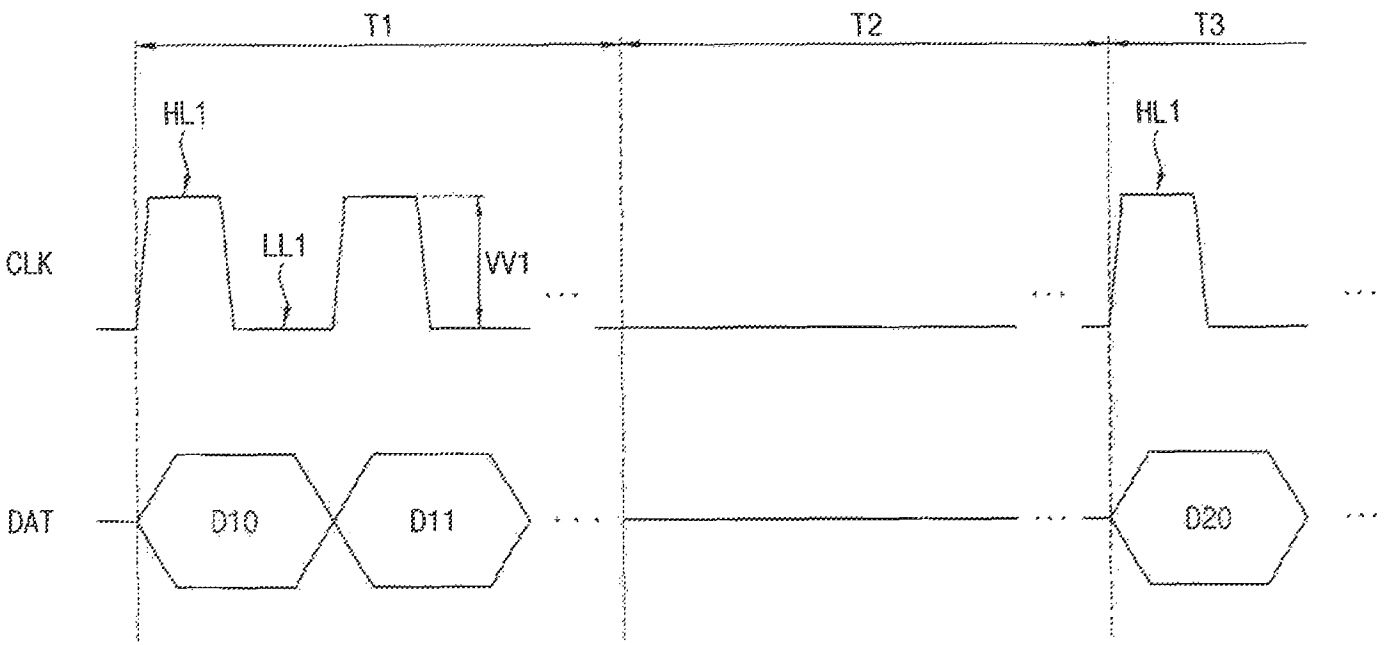
FIGS. 15A and 15B are timing diagrams for describing a method of operating the display apparatus according to exemplary embodiments of the present inventive concept.
Figure 15B:
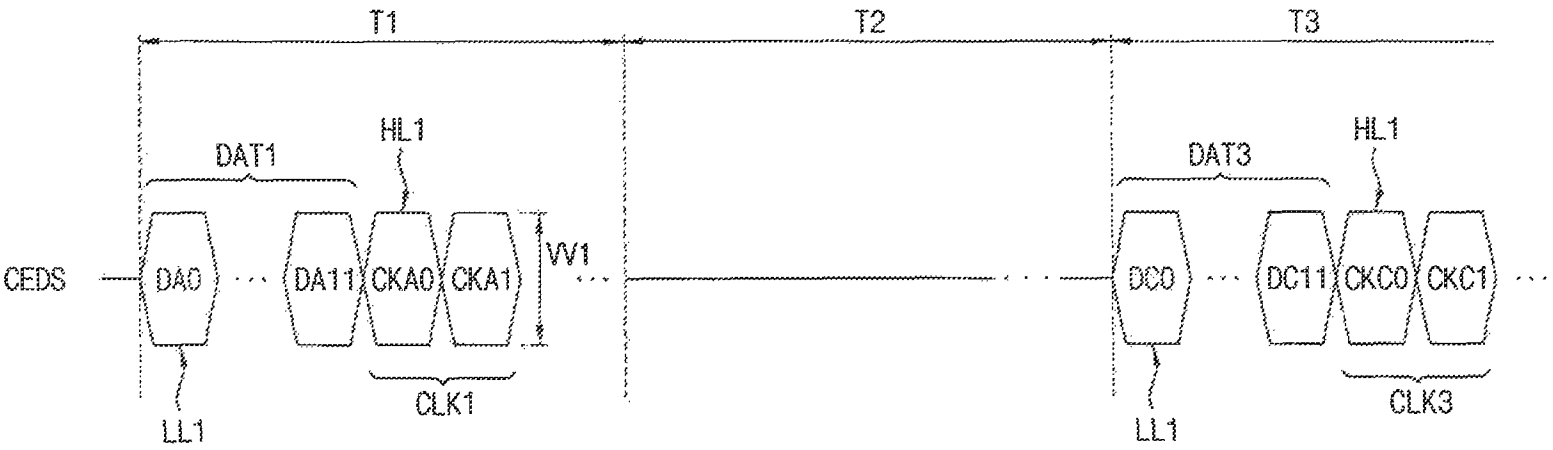

FIGS. 15A and 15B are timing diagrams for describing a method of operating the display apparatus according to exemplary embodiments of the present inventive concept.

Referring to FIGS. 14 and 15A, a timing diagram of FIG. 15A may be substantially the same as a timing diagram of FIG. 3, except that a clock signal CLK is prevented from toggling in a period T2 of FIG. 15A. In exemplary embodiments of the present inventive concept, the timing controller 200*a* of FIG. 4 may generate the clock signal CLK illustrated in FIG. 15A. To generate the clock signal CLK illustrated in FIG. 15A, the clock generator 230*a* in FIG. 4 may prevent the clock signal CLK from toggling (e.g., may block an output of the clock signal CLK) during the second period T2.

Referring to FIGS. 14 and 15B, a timing diagram of FIG. 15B may be substantially the same as a timing diagram of FIG. 9, except that a clock embedded data signal CEDS is prevented from toggling in a period T2 of FIG. 15B. In exemplary embodiments of the present inventive concept, the timing controller 200*c* of FIG. 10 may generate the clock embedded data signal CEDS illustrated in FIG. 15B. To generate the clock embedded data signal CEDS illustrated in FIG. 15B, the clock embedded data signal generator 230*c* in FIG. 10 may prevent the clock embedded data signal CEDS from toggling during the second period T2.

When the timing controller 200*b* of FIG. 7 generates the clock signal CLK illustrated in FIG. 6, the clock signal CLK may be prevented from toggling in the period T2. This is also applicable to the embodiments illustrated in FIGS. 15A and 15B.

Figure 16:
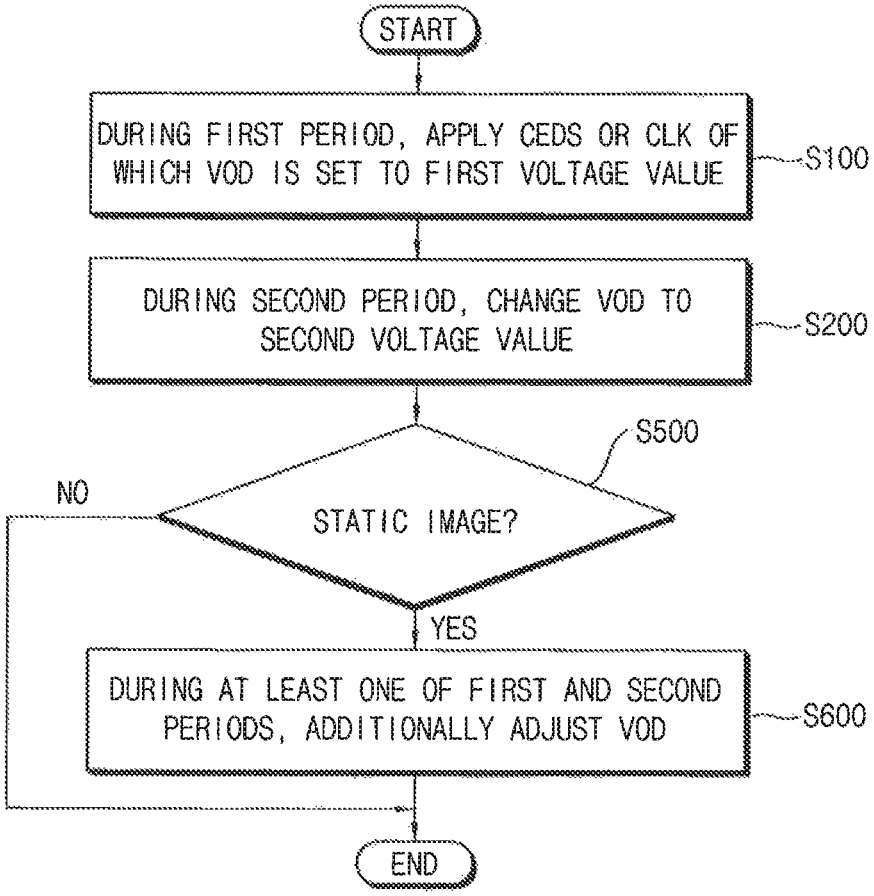
FIG. 16 is a flow chart illustrating a method of operating a display apparatus according to exemplary embodiments of the present inventive concept.

FIG. 16 is a flow chart illustrating a method of operating a display apparatus according to exemplary embodiments of the present inventive concept.

Referring to FIGS. 1 and 16, in a method of operating the display apparatus 10, during a first period, a clock embedded data signal CEDS or a clock signal CLK having a VOD set to a first voltage value is applied to the data driver 400 (step S100). During a second period, the VOD of the clock embedded data signal CEDS or the VOD of the clock signal CLK that is applied to the data driver 400 is changed to a second voltage value smaller than the first voltage value (step S200). Steps S100 and S200 in FIG. 16 may be substantially the same as steps S100 and S200 in FIG. 2, respectively.

It may be determined whether output image data DAT provided to the data driver 400 corresponds to a static image (step S500). For example, when at least two consecutive frame images are substantially the same as each other, it may be determined that the output image data DAT corresponds to the static image.

When it is determined that the output image data DAT corresponds to the static image (step S500: YES), during at least one of the first period and the second period, the VOD of the clock embedded data signal CEDS or the VOD of the clock signal CLK may be additionally adjusted (step S600). For example, during at least one of the first period and the second period, the timing controller 200 may further reduce the VOD of the clock embedded data signal CEDS or the VOD of the clock signal CLK.

When it is determined that the output image data DAT does not correspond to the static image (step S500: NO), for example, when the output image data DAT corresponds to a dynamic image (e.g., a moving image, a video, etc.), additional operations for adjusting the VOD may not be performed.

FIGS. 17A, 17B, 18A, 18B, 19A and 19B are timing diagrams for describing a method of operating the display apparatus according to exemplary embodiments of the present inventive concept.

Figure 17A:
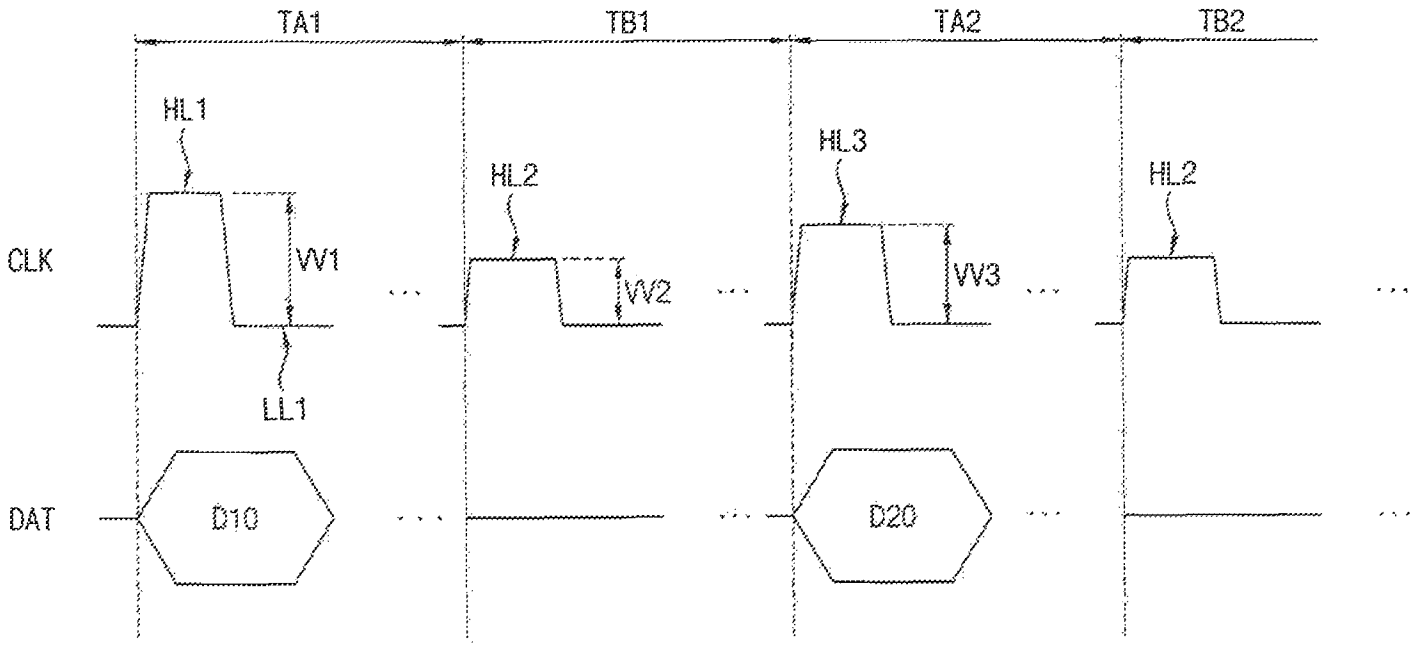
FIGS. 17A, 17B, 18A, 18B, 19A and 19B are timing diagrams for describing a method of operating the display apparatus according to exemplary embodiments of the present inventive concept.
Figure 17B:
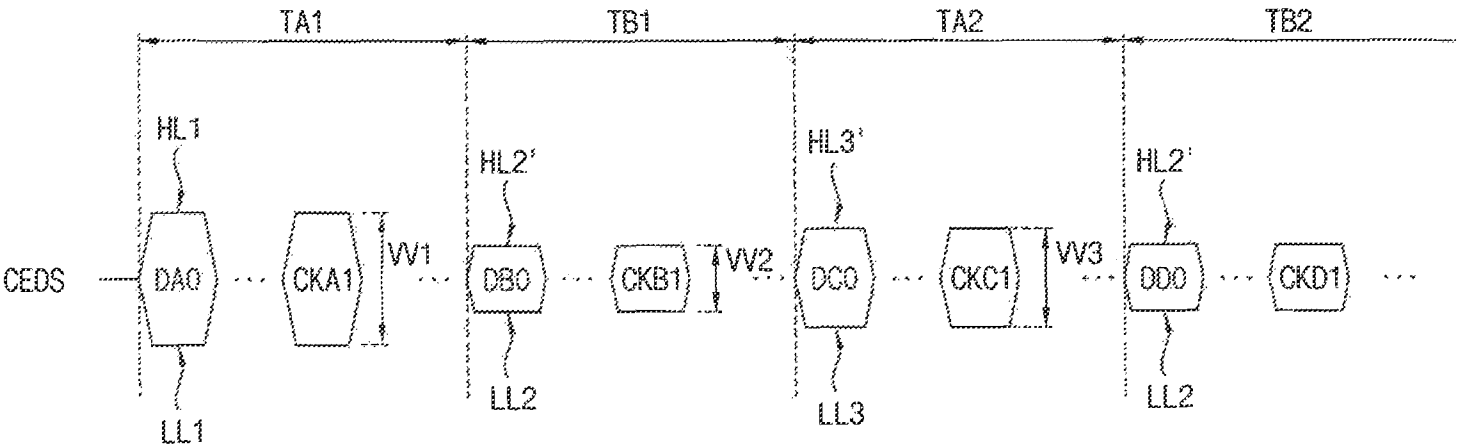

Referring to FIGS. 16, 17A and 17B, each of periods TA1 and TA2 may correspond to the first period, and each of periods TB1 and TB2 may correspond to the second period. For example, the period TA1 may represent a first frame period for displaying a first frame image, and the period TA2 may represent a second frame period for displaying a second frame image. The first and second frame images may be two consecutive frames images. The period TB1 may represent a first blank period between the first frame period and the second frame period, and the period TB2 may represent a second blank period subsequent to the second frame period.

In examples of FIGS. 17A and 17B, when the static image is displayed on the display panel 100, a VOD of a clock signal CLK or a VOD of a clock embedded data signal CEDS may be further reduced during the second frame period. For example, when the second frame image is substantially the same as the first frame image, or when image data corresponding to the period TA1 is substantially the same as image data corresponding to the period TA2, it may be determined that a static image is displayed on the display panel 100.

In the example of FIG. 17A, operations in the periods TA1 and TB1 of FIG. 17A may be substantially the same as the operations in the periods T1 and T2 of FIG. 3, respectively.

In the period TA2 of FIG. 17A after the period TB1, the output image data DAT is provided to the data driver 400. The VOD of the clock signal CLK is changed from the second voltage value VV2 to a third voltage value VV3, and then, the clock signal CLK having the increased VOD is applied to the data driver 400. For example, the clock signal CLK may toggle or swing between a third high level HL3 and the first low level LL1 during the period TA2. The third high level HL3 may have a voltage level lower than that of the first high level HL1 and higher than that of the second high level HL2. In other words, the third voltage value VV3 may be smaller than the first voltage value VV1 and may be greater than the second voltage value VV2.

An operation in the period TB2 of FIG. 17A after the period TA2 may be substantially the same as the operation in the period TB1 of FIG. 17A.

In the example of FIG. 17B, operations in the periods TA1 and TB1 of FIG. 17B may be substantially the same as the operations in the periods T1 and T2 of FIG. 9, respectively.

In the period TA2 of FIG. 17B after the period TB1, the output image data DAT is provided to the data driver 400. The VOD of the clock embedded data signal CEDS is changed from the second voltage value VV2 to a third voltage value VV3, and then, the clock embedded data signal CEDS having the increased VOD is applied to the data driver 400. For example, the clock embedded data signal CEDS may toggle or swing between a third high level HL3' and a third low level LL3 during the period TA2. The third high level HL3' may have a voltage level lower than that of the first high level HL1 and higher than that of the second high level HL2'. The third low level LL3 may have a voltage level higher than that of the first low level LL1 and lower than that of the second low level LL2. In other words, the third voltage value VV3 may be smaller than the first voltage value VV1 and may be greater than the second voltage value VV2.

An operation in the period TB2 of FIG. 17B after the period TA2 may be substantially the same as the operation in the period TB1 of FIG. 17B.

Figure 18A:
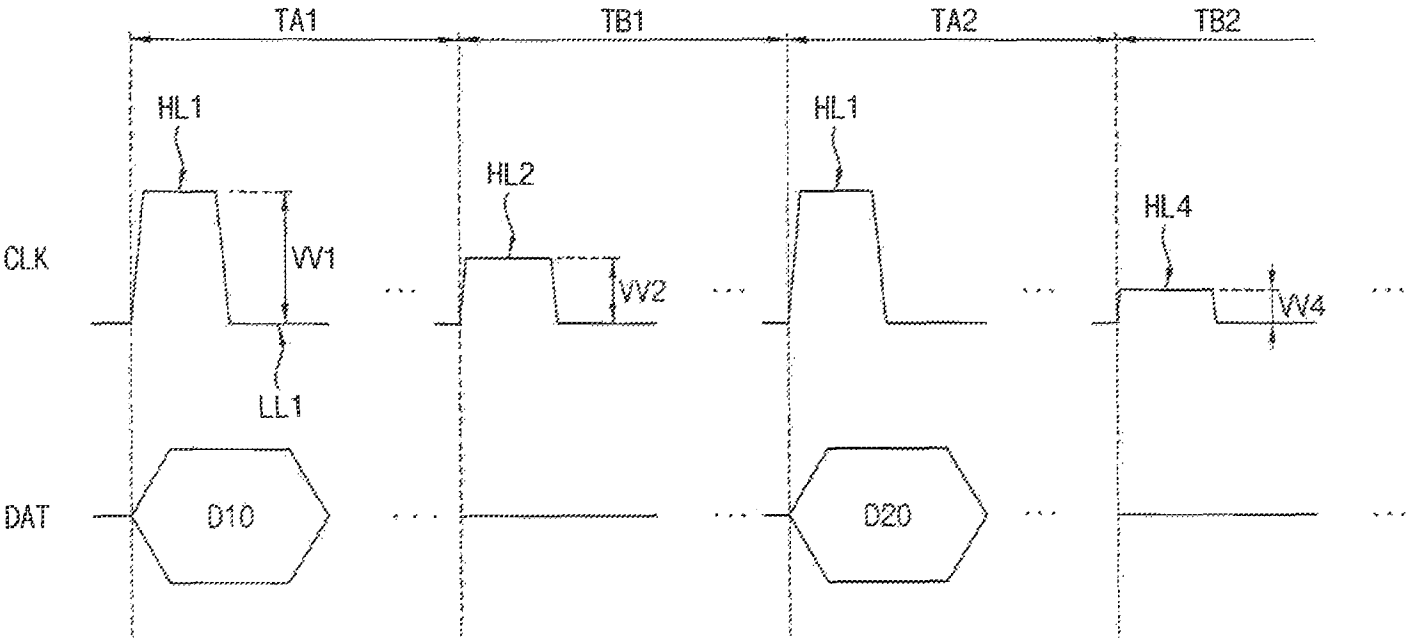
Figure 18B:
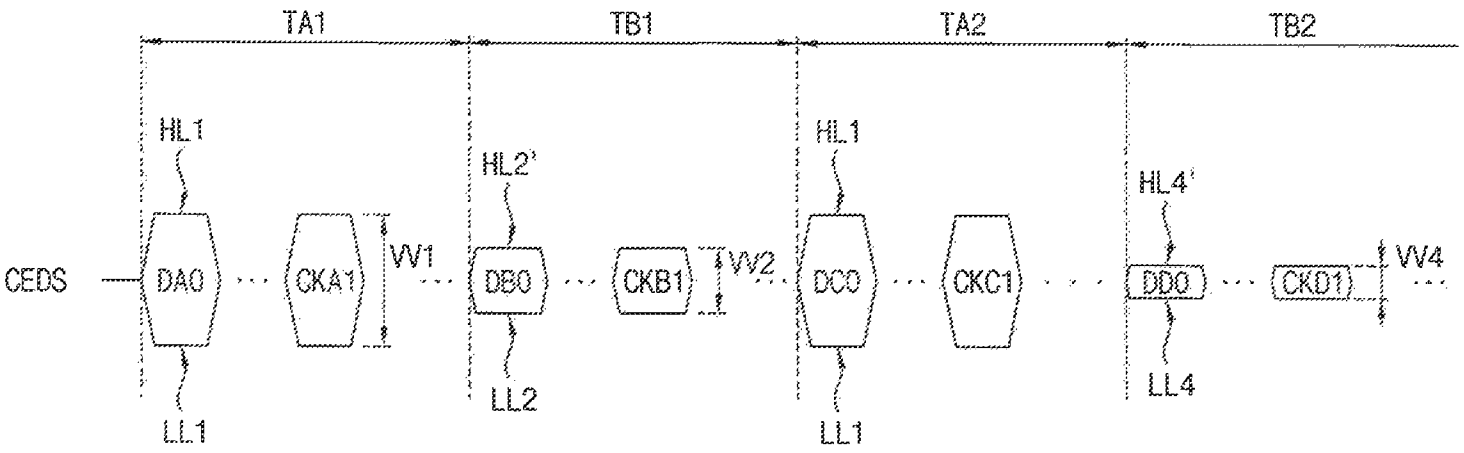

Referring to FIGS. 16, 18A and 18B, periods TA1, TB1, TA2 and TB2 in FIGS. 18A and 18B may be substantially the same as the periods TA1, TB1, TA2 and TB2 in FIGS. 17A and 17B, respectively. In the examples of FIGS. 18A and 18B, when a static image is displayed on the display panel 100, a VOD of a clock signal CLK or a VOD of a clock embedded data signal CEDS may be further reduced during the second blank period TB2.

Operations in the periods TA1, TB1 and TA2 of FIG. 18A may be substantially the same as the operations in the periods T1, T2 and T3 of FIG. 3, respectively.

In the period TB2 of FIG. 18A after the period TA2, the output image data DAT is not provided to the data driver 400. The VOD of the clock signal CLK is changed from the first voltage value VV1 to a fourth voltage value VV4, and then, the clock signal CLK having the reduced VOD is applied to the data driver 400. For example, the clock signal CLK may toggle or swing between a fourth high level HL4 and the first low level LL1 during the period TB2. The fourth high level HL4 may have a voltage level lower than that of the second high level HL2. In other words, the fourth voltage value VV4 may be smaller than the second voltage value VV2.

Operations in the periods TA1, TB1 and TA2 of FIG. 18B may be substantially the same as the operations in the periods T1, T2 and T3 of FIG. 9, respectively.

In the period TB2 of FIG. 18B after the period TA2, the output image data DAT is not provided to the data driver 400. The VOD of the clock embedded data signal CEDS is changed from the first voltage value VV1 to a fourth voltage value VV4, and then, the clock embedded data signal CEDS having the reduced VOD is applied to the data driver 400. For example, the clock embedded data signal CEDS may toggle or swing between a fourth high level HL4' and a fourth low level LL4 during the period TB2. The fourth high level HL4' may have a voltage level lower than that of the second high level HL2'. The fourth low level LL4 may have a voltage level higher than that of the second low level LL2. In other words, the fourth voltage value VV4 may be smaller than the second voltage value VV2.

Figure 19A:
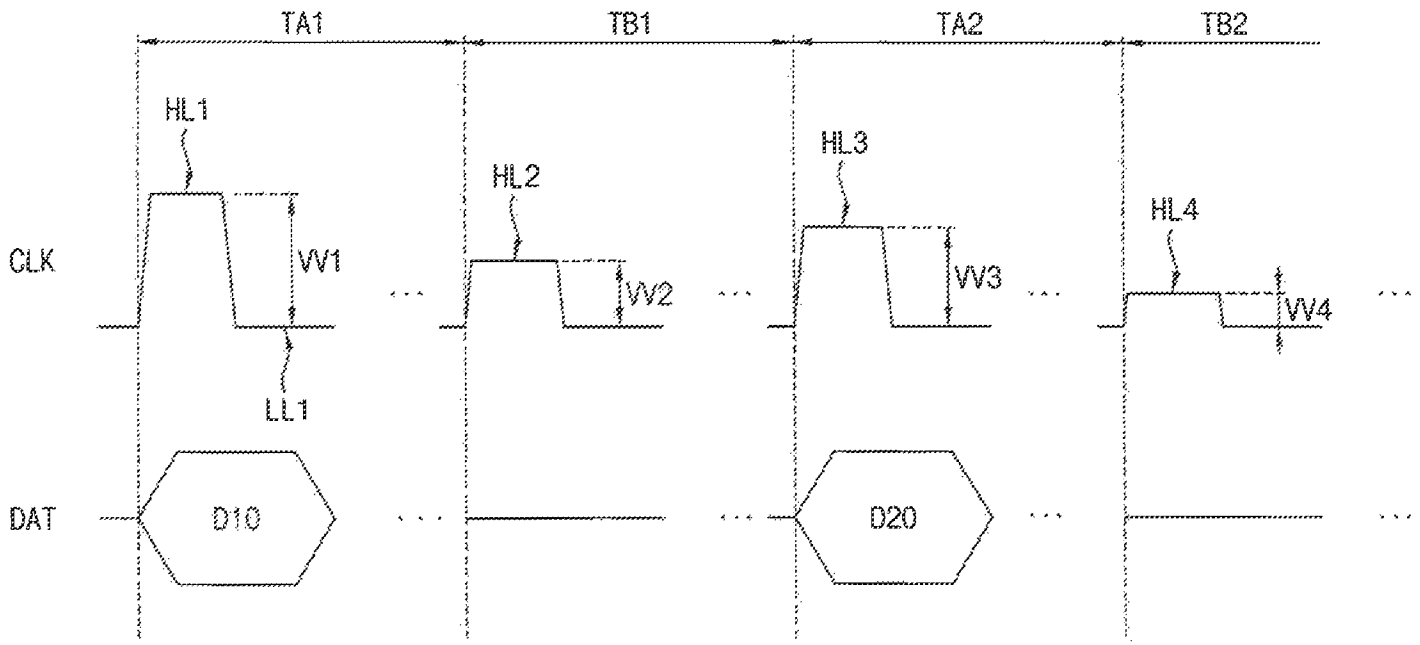
Figure 19B:
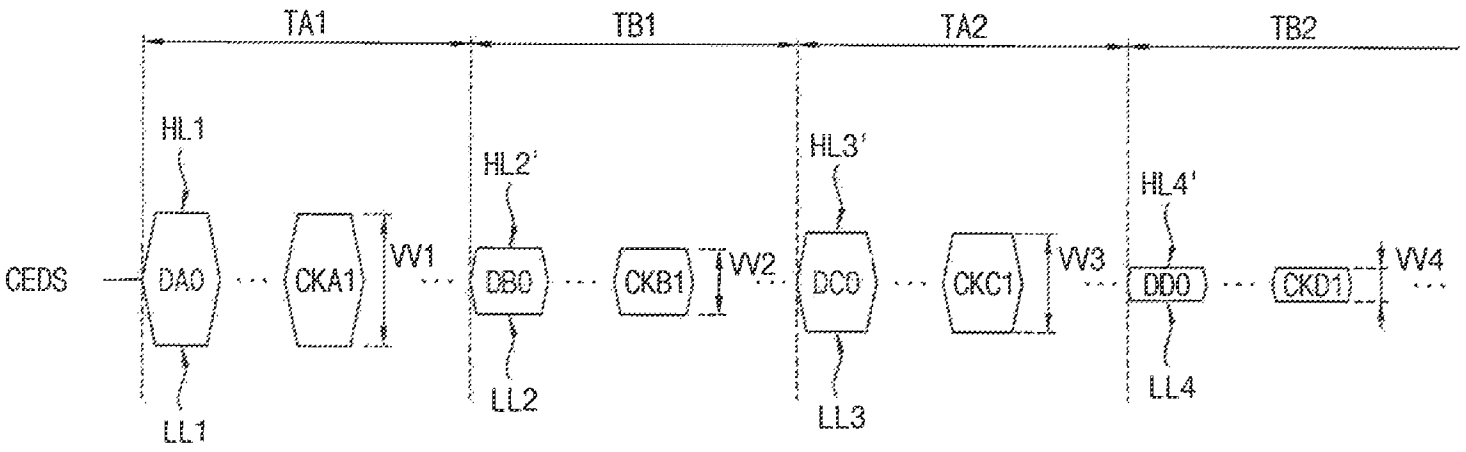

Referring to FIGS. 16, 19A and 19B, periods TA1, TB1, TA2 and TB2 in FIGS. 19A and 19B may be substantially the same as the periods TA1, TB1, TA2 and TB2 in FIGS. 17A and 17B, respectively. In the examples of FIGS. 19A and 19B, when a static image is displayed on the display panel 100, a VOD of a clock signal CLK or a VOD of a clock embedded data signal CEDS may be further reduced during both the second frame period TA2 and the second blank period TB2.

Operations in the periods TA1, TB1 and TA2 of FIG. 19A may be substantially the same as the operations in the periods TA1, TB1 and TA2 of FIG. 17A, respectively. An operation in the period TB2 of FIG. 19A may be substantially the same as the operation in the period TB2 of FIG. 18A.

Operations in the periods TA1, TB1 and TA2 of FIG. 19B may be substantially the same as the operations in the periods TA1, TB1 and TA2 of FIG. 17B, respectively. An operation in the period TB2 of FIG. 19B may be substantially the same as the operation in the period TB2 of FIG. 18B.

Figure 20A:
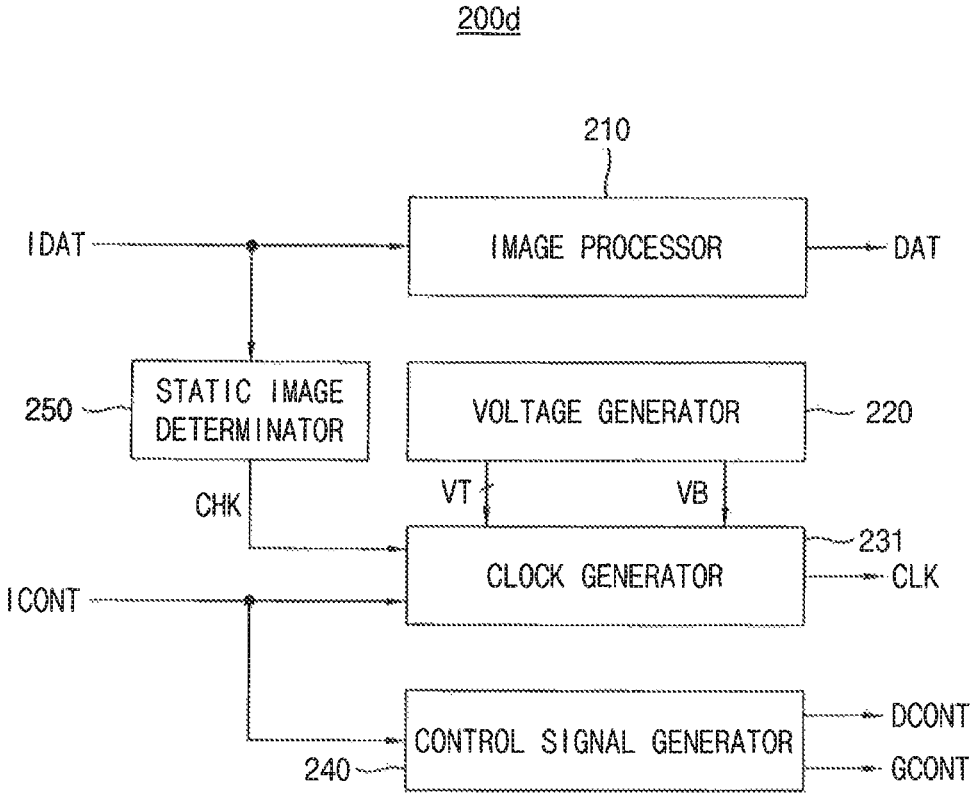
FIGS. 20A and 20B are block diagrams illustrating a timing controller included in the display apparatus according to exemplary embodiments of the present inventive concept.
Figure 20B:
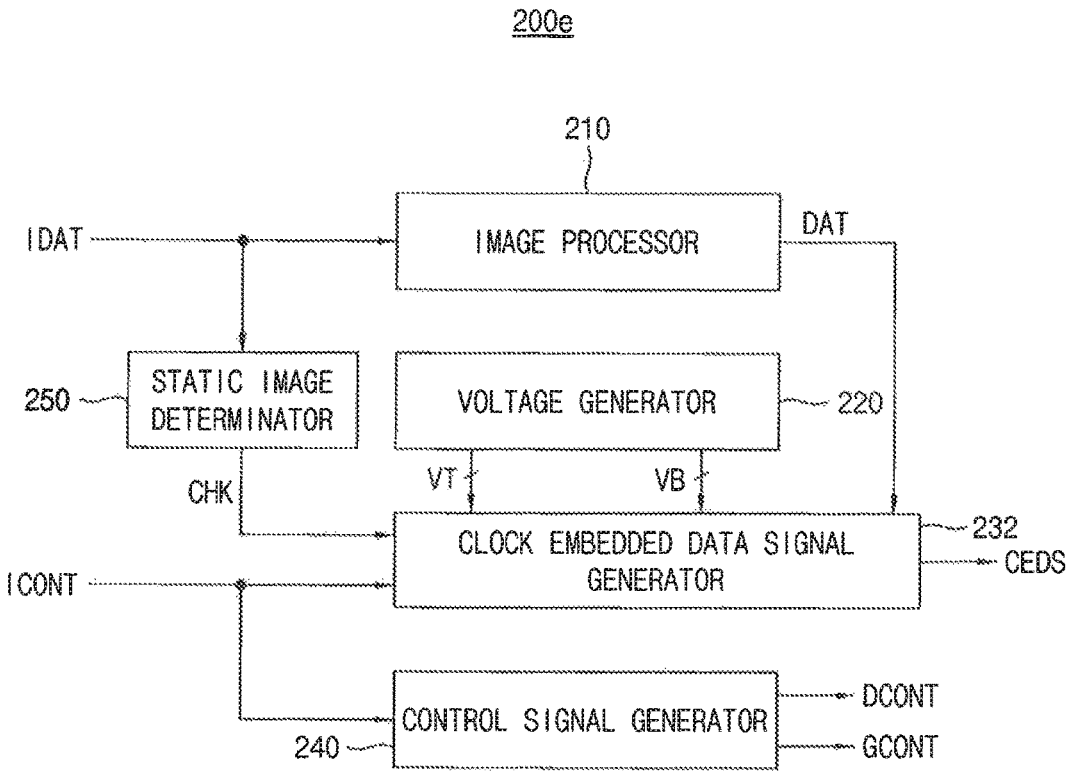

FIGS. 20A and 20B are block diagrams illustrating a timing controller included in the display apparatus according to exemplary embodiments of the present inventive concept.

Referring to FIG. 20A, a timing controller 200*d* may include an image processor 210, a voltage generator 220, a clock generator 231, a control signal generator 240 and a static image determinator 250. The timing controller 200*d* of FIG. 20A may generate the clock signal CLK illustrated in one of FIGS. 17A, 18A and 19A, for example.

The image processor 210 and the control signal generator 240 in FIG. 20A may be substantially the same as the image processor 210 and the control signal generator 240 in FIG. 4, respectively.

The voltage generator 220 may generate a plurality of high voltages VT and at least one low voltage VB. The voltage generator 220 may include at least one high voltage generator that generates the plurality of high voltages VT and at least one low voltage generator that generates the at least one low voltage VB.

The static image determinator 250 may determine based on the input image data IDAT whether a static image or a dynamic image is displayed on the display panel 100, and may generate a check signal CHK indicating a result of the determination. For example, the static image determinator 250 may determine that the image data IDAT corresponds to the static image or the dynamic image by comparing a previous frame image with a current frame image. When it is determined that the static image is displayed on the display panel 100, the check signal CHK may have a first logic level (e.g., a logic high level). When it is determined that the dynamic image is displayed on the display panel 100, the check signal CHK may have a second logic level (e.g., a logic low level). The static image determinator 250 may include at least one frame memory and/or at least one line memory that stores data corresponding to the previous frame image.

The clock generator 231 may generate the clock signal CLK based on the input control signal ICONT, the check signal CHK, the plurality of high voltages VT and the at least one low voltage VB. For example, as illustrated in FIGS. 17A, 18A and 19A, the VOD of the clock signal CLK may be reduced during the periods TB1 and TB2. In addition, when the static image is displayed on the display panel 100, the VOD of the clock signal CLK may be further reduced during at least one of the periods TA2 and TB2.

Referring to FIG. 20B, a timing controller 200*e* may include an image processor 210, a voltage generator 220, a clock embedded data signal generator 232, a control signal generator 240 and a static image determinator 250. The timing controller 200*e* of FIG. 20B may generate the clock embedded data signal CEDS illustrated in one of FIGS. 17B, 18B and 19B, for example.

The image processor 210, the voltage generator 220, the control signal generator 240 and the static image determinator 250 in FIG. 20B may be substantially the same as the image processor 210, the voltage generator 220, the control signal generator 240 and the static image determinator 250 in FIG. 20A, respectively.

The clock embedded data signal generator 232 may generate the clock embedded data signal CEDS based on the input control signal ICONT, the output image data DAT, the check signal CHK, the high voltages VT and the low voltages VB. For example, as illustrated in FIGS. 17B, 18B and 19B, the VOD of the clock embedded data signal CEDS may be reduced during the periods TB1 and TB2. In addition, when the static image is displayed on the display panel 100, the VOD of the clock embedded data signal CEDS may be further reduced during at least one of the periods TA2 and TB2.

When the timing controller 200*b* of FIG. 7 generates the clock signal CLK illustrated in FIG. 6, the VOD of the clock signal CLK may be additionally adjusted during at least one of the first period and the second period when the output image data DAT corresponds to the static image. For example, the timing controller 200*b* of FIG. 7 may further include the static image determinator 250. This is also applicable to the embodiments illustrated in FIGS. 17A, 17B, 18A, 18B, 19A and 19B.

Figure 21:
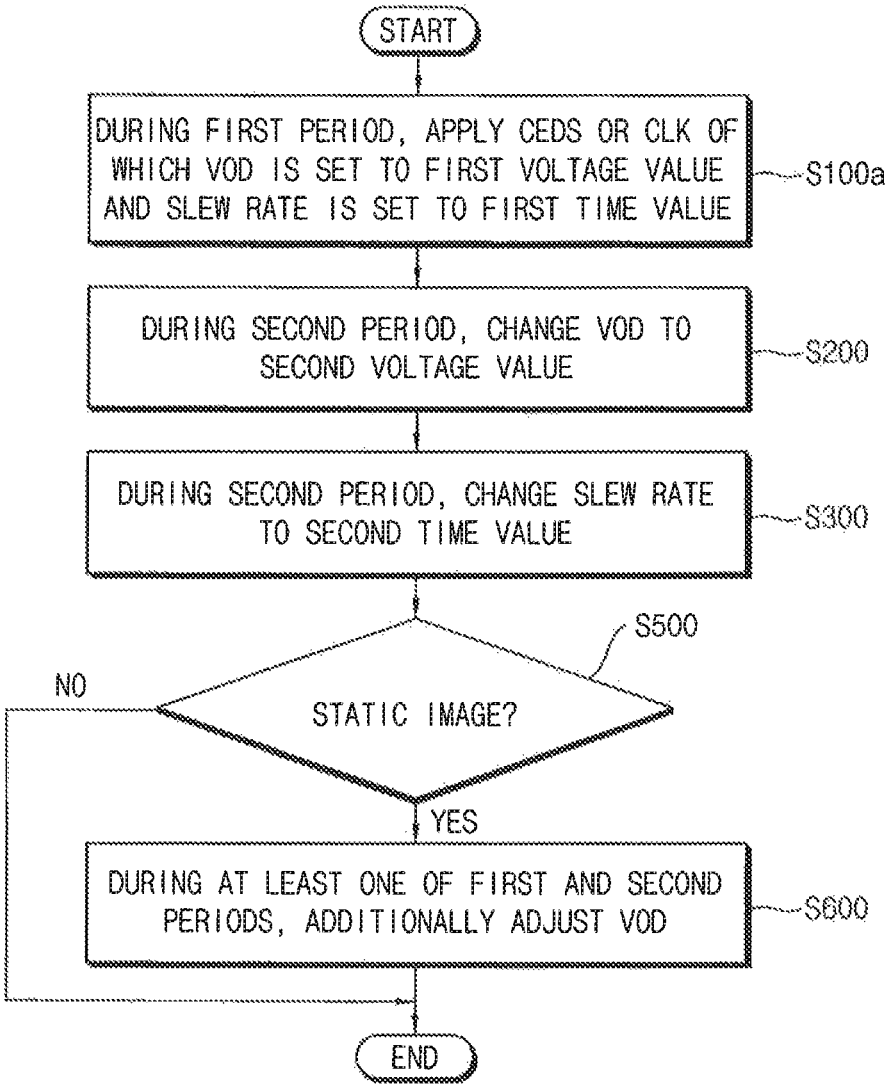
FIG. 21 is a flow chart illustrating a method of operating a display apparatus according to exemplary embodiments of the present inventive concept.

FIG. 21 is a flow chart illustrating a method of operating a display apparatus according to exemplary embodiments of the present inventive concept.

Referring to FIGS. 1 and 21, in a method of operating the display apparatus 10, during a first period, a clock embedded data signal CEDS or a clock signal CLK having a VOD set to a first voltage value and a slew rate set to a first time value is applied to the data driver 400 (step S100*a*). During a second period, the VOD of the clock embedded data signal CEDS or the VOD of the clock signal CLK that is applied to the data driver 400 is changed to a second voltage value smaller than the first voltage value (step S200). During the second period, the slew rate of the clock embedded data signal CEDS or the slew rate of the clock signal CLK may be changed to a second time value greater than the first time value (step S300). Steps S100*a*, S200 and S300 in FIG. 21 may be substantially the same as steps S100*a*, S200 and S300 in FIG. 11, respectively.

It may be determined whether output image data DAT provided to the data driver 400 corresponds to a static image (step S500). When it is determined that the output image data DAT corresponds to the static image (step S500: YES), during at least one of the first period and the second period, the VOD of the clock embedded data signal CEDS or the VOD of the clock signal CLK may be additionally adjusted (step S600). Steps S500 and S600 in FIG. 21 may be substantially the same as steps S500 and S600 in FIG. 16, respectively.

Figure 22:
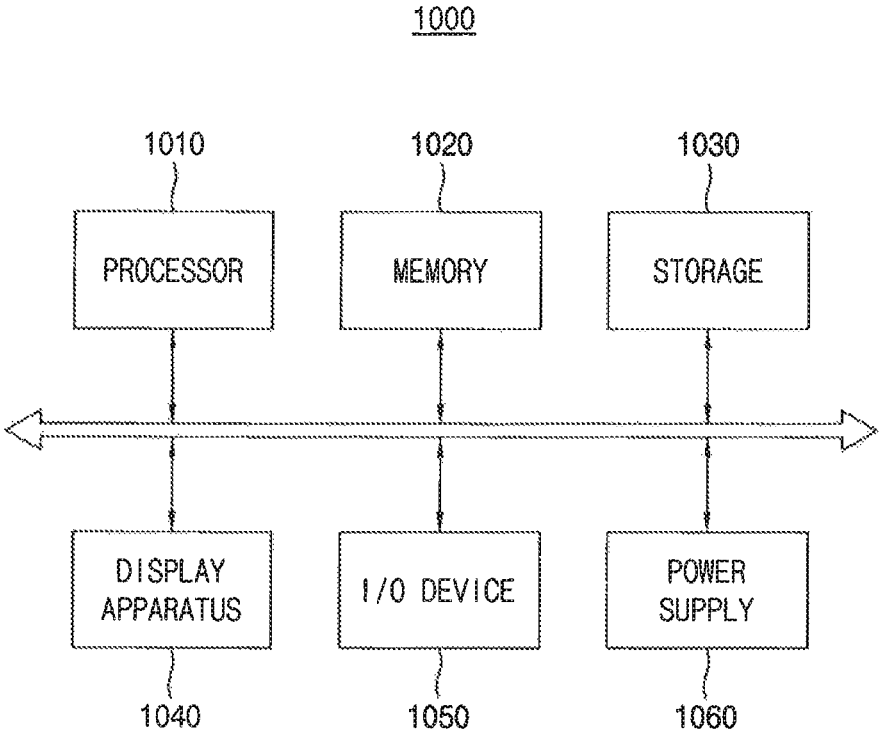
FIG. 22 is a block diagram illustrating an electronic system including the display apparatus according to example embodiments of the present inventive concept.
Figure 23A:
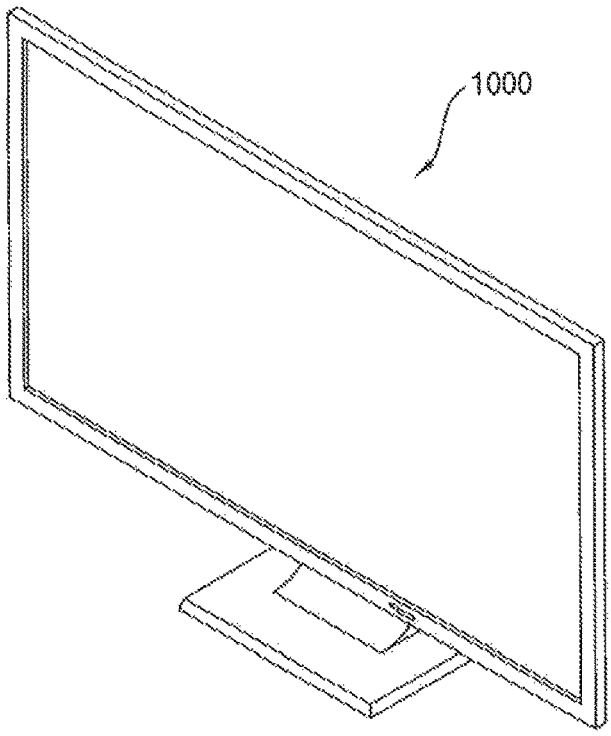
FIGS. 23A and 23B are diagrams illustrating the electronic system of FIG. 22 according to exemplary embodiments of the present inventive concept.
Figure 23B:
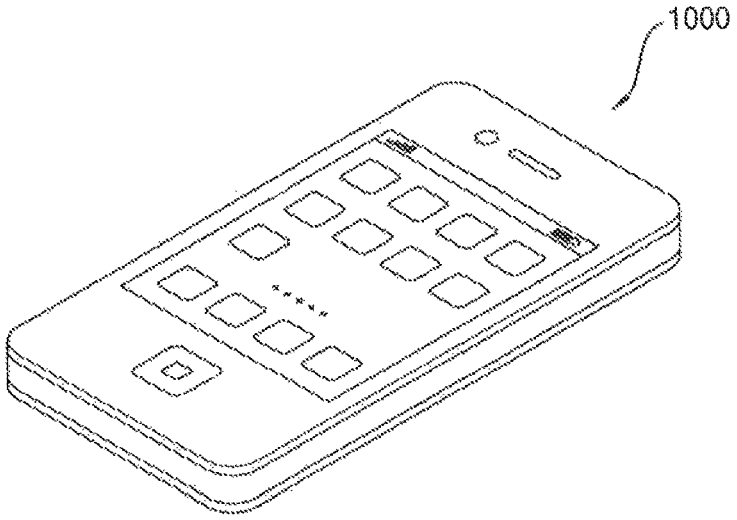

FIG. 22 is a block diagram illustrating an electronic system including a display apparatus according to exemplary embodiments of the present inventive concept. FIGS. 23A and 23B are diagrams illustrating the electronic system of FIG. 22 according to exemplary embodiments of the present inventive concept.

Referring to FIGS. 22, 23A and 23B, an electronic system 1000 includes a processor 1010, a memory 1020, a storage device 1030, a display apparatus 1040, an input/output (I/O) device 1050 and a power supply 1060.

In an exemplary embodiment of the present inventive concept, as illustrated in FIG. 23A, the electronic system 1000 may be a television. As illustrated in FIG. 23B, the electronic system 1000 may be a smart phone. In addition, the electronic system 1000 may be any computing system, such as a personal computer (PC), a server computer, a workstation, a digital television, a set-top box, etc., and/or may be any mobile system, such as a mobile phone, a tablet computer, a laptop computer, a personal digital assistant (PDA), a portable multimedia player (PMP), a digital camera, a portable game console, a music player, a camcorder, a video player, a navigation system, etc. The mobile system may further include a wearable device, an internet of things (IoT) device, an internet of everything (IoE) device, an e-book, a virtual reality (VR) device, an augmented reality (AR) device, a robotic device, etc.

The processor 1010 may perform various computational functions such as particular calculations and tasks. For example, the processor 1010 may be a central processing unit (CPU), a microprocessor, an application processor (AP), etc.

The memory 1020 and the storage device 1030 may store data used for operating the electronic system 1000 and/or data processed by the processor 1010. For example, the memory 1020 may include a volatile memory such as a dynamic random access memory (DRAM), a static random access memory (SRAM), etc., and/or a non-volatile memory such as an electrically erasable programmable read-only memory (EEPROM), a flash memory, a phase change random access memory (PRAM), a resistance random access memory (RRAM), a magnetic random access memory (MRAM), a ferroelectric random access memory (FRAM), a nano floating gate memory (NFGM), or a polymer random access memory (PoRAM), etc. The storage device 1030 may include a compact disk read only memory (CD-ROM), a hard disk drive (HDD), a solid state drive (SSD), etc.

The I/O device 1050 may include at least one input device such as a keypad, a button, a microphone, a touch screen, etc., and/or at least one output device such as a speaker, a display device, etc. The power supply 1060 may provide power to the electronic system 1000.

The display apparatus 1040 may be the display apparatus 10 according to exemplary embodiments of the present inventive concept, and may operate based on the examples described with reference to FIGS. 2 through 21. For example, the display apparatus 1040 may include a timing controller and a data driver. During a period in which the output image data DAT is not provided from the timing controller to the data driver, at least one of the VOD, the slew rate and toggling of the clock embedded data signal CEDS or the clock signal CLK provided to the data driver may be controlled. In addition, the VOD and the slew rate of the clock embedded data signal CEDS or the clock signal CLK may be further controlled based on whether an image displayed on the display apparatus 1040 is a static image. Accordingly, harmonic noise caused by the clock embedded data signal CEDS or the clock signal CLK in the display apparatus 1040 may be reduced without having to change a frequency of the clock embedded data signal CEDS or the clock signal CLK, and thus, desense in the electronic system 1000 including the display apparatus 1040 may be reduced. In addition, the display apparatus 1040 and the electronic system 1000 may have low power consumption.

As will be appreciated by those skilled in the art, the present inventive concept may be embodied as a system, method, computer program product, and/or a computer program product embodied in one or more computer readable medium(s) having computer readable program code embodied thereon. The computer readable program code may be provided to a processor of a general purpose computer, special purpose computer, or other programmable data processing apparatus. The computer readable medium may be a computer readable signal medium or a computer readable storage medium. The computer readable storage medium may be any tangible medium that can contain, or store a program for use by or in connection with an instruction execution system, apparatus, or device. For example, the computer readable medium may be a non-transitory computer readable medium.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a PC, a server computer, a workstation, a tablet computer, a laptop computer, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A method of operating a display apparatus, the method comprising:

during a first period in which image data is provided to a data driver, applying a clock embedded data signal having an output differential voltage ("VOD") set to a first voltage value to the data driver, wherein the VOD of the clock embedded data signal relates to a voltage difference between a high level and a low level of the clock embedded data signal; and during a second period in which the image data is not provided to the data driver, changing the VOD of the clock embedded data signal applied to the data driver to a second voltage value smaller than the first voltage value, wherein, during the whole first period, each of the high level and the low level of the clock embedded data signal is a fixed level, and the VOD of the clock embedded data signal is maintained to the first voltage value.

2. The method of claim 1, wherein the second period includes:

a first blank period between two consecutive frame periods for displaying two consecutive frame images.

3. The method of claim 2, wherein the second period further includes:

a second blank period between two consecutive line periods for displaying two consecutive line images in one frame image.

4. The method of claim 1, wherein, during the first period, a slew rate of the clock embedded data signal is set to a first time value, wherein the slew rate of the clock embedded data signal relates to a time required to transition from one of the high level and the low level of the clock embedded data signal to the other of the high level and the low level of the clock embedded data signal, the method further comprising:

during the second period, changing the slew rate of the clock embedded data signal applied to the data driver to a second time value greater than the first time value.

5. The method of claim 4, wherein the second time value is greater than the first time value and is equal to or smaller than three times the first time value.

6. The method of claim 1, wherein the clock embedded data signal applied to the data driver is not toggled during the second period.

7. The method of claim 1, further comprising:

determining whether the image data corresponds to a static image; and during at least one of the first period and the second period, additionally adjusting the VOD of the clock embedded data signal when the image data corresponds to the static image.

8. The method of claim 7, wherein the first period includes a first frame period for displaying a first frame image, and a second frame period for displaying a second frame image, wherein the first and second frame images are two consecutive frame images, wherein the second period includes a first blank period between the first frame period and the second frame period, and a second blank period after the second frame period, wherein the VOD of the clock embedded data signal is set to the first voltage value during the first frame period, and the VOD of the clock embedded data signal is changed from the first voltage value to the second voltage value during the first blank period.

9. The method of claim 8, wherein when the second frame image is the same as the first frame image, the VOD of the clock embedded data signal is changed to a third voltage value during the second frame period, wherein the third voltage value is smaller than the first voltage value and is greater than the second voltage value.

10. The method of claim 8, wherein when the second frame image is the same as the first frame image, the VOD of the clock embedded data signal is changed to a third voltage value during the second blank period, wherein the third voltage value is smaller than the second voltage value.

11. The method of claim 1, wherein applying the clock embedded data signal to the data driver during the first period includes:

generating a first high voltage and a first low voltage; and outputting the dock embedded data signal in response to the first high voltage and the first low voltage, wherein a difference between the first high voltage and the first low voltage is equal to the first voltage value.

12. The method of claim 11, wherein changing the VOD of the clock embedded data signal during the second period includes:

generating a second high voltage and a second low voltage, wherein the second high voltage has a level lower than that of the first high voltage, and the second low voltage has a level higher than that of the first low voltage; and outputting the clock embedded data signal in response to the second high voltage and the second low voltage, wherein a difference between the second high voltage and the second low voltage is equal to the second voltage value.

13. A method of operation a display apparatus, the method comprising:

during a first period in which image data is provided to a data driver, applying a clock embedded data signal having an output differential voltage ("VOD") set to a first voltage value to the data driver, wherein the VOD of the clock embedded data signal relate to a voltage different between high level and a low of the clock embedded data signal; and during a second period in which the image data is not provided to the data driver, changing the VOD of the clock embedded data signal applied to the data driver to a second voltage value smaller than the first voltage value, wherein the second voltage value is equal to or greater than 30% of the first voltage value and is equal to or smaller than 80% of the first voltage value.

14. A method of operating a display apparatus, the method comprising:

during a first period in which image data is provided to a data driver, applying a clock signal having an output differential voltage ("VOD") set to a first voltage value to the data driver, wherein the VOD of the clock signal relates to a voltage difference between a high level and a low level of the clock signal; and during a second period in which the image data is not provided to the data driver, changing the VOD of the clock signal applied to the data driver to a second voltage value smaller than the first voltage value, wherein, during the whole first period, each of the high level and the low level of the clock signal is a fixed level, and the VOD of the clock signal is maintained to the first voltage value.

15. The method of claim 14, Wherein, during the first period, a slew rate of the clock signal is set to a first time value, wherein the slew rate of the clock signal relates to a time required to transition from one of the high level and the low level of the clock signal to the other of the high level and the low level of the clock signal, the method further comprising:

during the second period, changing the slew rate of the clock signal applied to the data driver to a second time value greater than the first time value.

16. The method of claim 15, wherein the second time value is greater than the first time value and is equal to or smaller than three times the first time value.

17. The method of claim 14, wherein applying the clock signal to the data driver during the first period includes:

generating a first high voltage and a first low voltage; and outputting the clock signal in response to the first high voltage and the first low voltage, wherein a difference between the first high voltage and the first low voltage is equal to the first voltage value.

18. The method of claim 17, wherein changing the VOD of the clock signal during the second period includes:

generating a second high voltage having a level lower than that of the first high voltage; and outputting the clock signal in response to the second high voltage and the first low voltage, wherein a difference between the second high voltage and the first low voltage is equal to the second voltage value.

19. The method of claim 17, wherein changing the VOD of the clock signal during the second period includes:

generating a second high voltage and a second low voltage, wherein the second high voltage has a level lower than that of the first high voltage, and the second low voltage has a level higher than that of the first low voltage; and outputting the dock signal in response to the second high voltage and the second low voltage, wherein a difference between the second high voltage and the second low voltage is equal to the second voltage value.

20. A method of operating a display apparatus, the method comprising:

during a first period in which image data is provided to a data driver, applying a clock signal having output differential voltage ("VOD") set to a first voltage value to the data driver, wherein the VOD of the clock signal relates to a voltage difference between a high level and a low level of the clock signal; and during a second period in which the image data is not provided to the data driver, changing the VOD of the clock signal applied to the data driver second voltage value smaller than the first voltage value, wherein the second voltage value is equal to or greater than 30% of the first voltage value and is equal to or smaller than 80% of the first voltage value.

21. A display apparatus, comprising:

a display panel;

a data driver connected to the display panel; and a timing controller configured to apply a clock embedded data signal to the data driver and configured to set an output differential voltage ("VOD") of the clock embedded data signal, wherein the VOD of the clock signal relates to a voltage difference between a high level and a low level of the clock embedded data signal, wherein the VOD of the clock embedded data signal is set to a first voltage value during a first period in which image data is provided to the data driver, and the VOD of the clock embedded data signal is changed to a second voltage value smaller than the first voltage value during a second period in which the image data is not provided to the data driver, wherein the timing controller is configured to set a slew rate of the clock embedded data signal to a time required to transition from one of the high level and the low level of the clock embedded data signal to the other level and the low level of the clock embedded data signal, wherein the slew rate of the clock embedded data signal is set to a first time value during the first period, and the slew rate of the clock embedded data is changed to a second time value greater than the first time value during the second period.

22. The display apparatus of claim 21, wherein the second voltage value is equal to or greater than 30% of the first voltage value and is equal to or smaller than 80% of the first voltage value.

23. The display apparatus of claim 21, wherein the second period includes:

a first blank period between two consecutive frame periods for displaying two consecutive frame images on the display panel.

24. The display apparatus of claim 23, wherein the second period further includes:

a second blank period between two consecutive line periods for displaying two consecutive line images in one frame image displayed on the display panel.

25. The display apparatus of claim 21, wherein the second time value is greater than the first time value and is equal to or smaller than three times the first time value.

26. The display apparatus of claim 21, wherein the timing controller is configured to prevent the clock embedded data signal from toggling during the second period.

27. The display apparatus of claim 21, wherein the timing controller is configured to:

determine whether the image data corresponds to a static image, and during at least one of the first period and the second period, additionally adjust the VOD of the clock embedded data signal when the image data corresponds to the static image.

28. The display apparatus of claim 27, wherein the first period includes a first frame period for displaying a first frame image, and a second frame period for displaying a second frame image, wherein the first and second frame images are two consecutive frame images, wherein the second period includes a first blank period between the first frame period and the second frame period, and a second blank period after the second frame period, wherein the VOD of the clock embedded data signal is set to the first voltage value during the first frame period, and the VOD of the clock embedded data signal is changed from the first voltage value to the second voltage value during the first blank period.

29. The display apparatus of claim 28, wherein when the second frame image is the same as the first frame image, the VOD of the clock embedded data signal is changed from the second voltage value to a third voltage value during the second frame period, wherein the third voltage value is smaller than the first voltage value and is greater than the second voltage value.

30. The display apparatus of claim 28, wherein when the second frame image is the same as the first frame image, the VOD of the clock embedded data signal is changed to a third voltage value during the second blank period, wherein the third voltage value is smaller than the second voltage value.

31. The display apparatus of claim 21, wherein the timing controller includes:

a voltage generator configured to generate a first high voltage, a first low voltage, a second high voltage and a second low voltage, wherein the second high voltage has a level lower than that of the first high voltage, and the second low voltage has a level higher than that of the first low voltage; and a clock embedded data signal generator configured to generate the clock embedded data signal in response to the first high voltage, the first low voltage, the second high voltage and the second low voltage.

32. The display apparatus of claim 31, wherein the clock embedded data signal generator is configured to:

during the first period, output the clock embedded data signal having the VOD of the first voltage value in response to the first high voltage and the first low voltage, and during the second period, output the dock embedded data signal having the VOD of the second voltage value in response to the second high voltage and the second low voltage.

33. A display apparatus, comprising:

a display panel;

a data driver connected to the display panel; and a timing controller configured to apply image data and a clock signal to the data driver and configured to set an output differential voltage ("VOD") of the clock signal, wherein the VOD of the clock signal relates to a voltage difference between a high level and a low level of the clock signal, wherein the VOD of the clock signal is set to a first voltage value during a first period in which the image data is provided to the data driver, and the VOD of the clock signal is changed to a second voltage value smaller than the first voltage value during a second period in which the image data is not provided to the data driver, wherein the timing controller is configured to set a slew rate of the clock signal to a time required to transition from one of the high level and the low level of the clock signal to the other of the high level and the low level of the clock signal, wherein the slew rate of the clock signal is set to a first time value during the first period, and the slew rate of the clock signal is changed to a second time value greater than the first time value dome the second period.

* * * * *